US006987365B2

(12) United States Patent
Koyama

(10) Patent No.: US 6,987,365 B2
(45) Date of Patent: Jan. 17, 2006

(54) LIGHT-EMITTING DEVICE, AND ELECTRIC DEVICE USING THE SAME

(75) Inventor: Jun Koyama, Kanagawa (JP)

(73) Assignee: Semiconductor Energy Laboratory Co., Ltd. (JP)

( * ) Notice: Subject to any disclaimer, the term of this patent is extended or adjusted under 35 U.S.C. 154(b) by 0 days.

(21) Appl. No.: 10/441,376

(22) Filed: May 20, 2003

(65) Prior Publication Data

US 2003/0214250 A1 Nov. 20, 2003

Related U.S. Application Data

(63) Continuation of application No. 09/849,841, filed on May 4, 2001, now Pat. No. 6,583,576.

(30) Foreign Application Priority Data

May 8, 2000 (JP) ..... 2000-135016

(51) Int. Cl.
*G09G 3/10* (2006.01)

(52) U.S. Cl. ..... 315/169.3; 345/92

(58) Field of Classification Search ... 315/169.1–169.3, 315/160; 345/44–45, 76–77, 84, 92; 257/59, 257/72

See application file for complete search history.

(56) References Cited

U.S. PATENT DOCUMENTS 5,748,165 A 5/1998 Kubota et al. ..... 345/96
5,882,761 A 3/1999 Kawami et al. ..... 428/69
5,990,629 A * 11/1999 Yamada et al. ..... 315/169.3
6,229,505 B1 5/2001 Fujii ..... 345/76
6,246,384 B1 * 6/2001 Sano ..... 345/76
6,303,963 B1 * 10/2001 Ohtani et al. ..... 257/350
6,377,235 B1 * 4/2002 Murade et al. ..... 345/100
6,399,988 B1 * 6/2002 Yamazaki ..... 257/344
6,512,271 B1 * 1/2003 Yamazaki et al. ..... 257/350
6,512,504 B1 * 1/2003 Yamauchi et al. ..... 345/87
6,531,713 B1 * 3/2003 Yamazaki ..... 257/59
6,583,472 B1 6/2003 Shibata et al. ..... 257/350
6,617,644 B1 * 9/2003 Yamazaki et al. ..... 257/347

FOREIGN PATENT DOCUMENTS

| | | |
|---|---|---|
| JP | 9-148066 | 6/1997 |
| JP | 10-214060 | 8/1998 |
| JP | 10-232649 | 9/1998 |
| JP | 10-312173 | 11/1998 |

* cited by examiner

*Primary Examiner*—Thuy Vinh Tran
(74) *Attorney, Agent, or Firm*—Cook, Alex, McFarron, Manzo, Cummings & Mehler Ltd.

(57) ABSTRACT

In order to obtain a light-emitting device having a higher aperture ratio in pixels than that of the prior art, a source signal line and a current supply line to be connected with a pixel unit are switched by a switching circuit to use a common wiring line, so that the number of wiring lines in the pixel unit is reduced to realize the high aperture ratio.

33 Claims, 15 Drawing Sheets

LIGHT-EMITTING DEVICE, AND ELECTRIC DEVICE USING THE SAME

This application is a continuation of the U.S. patent application Ser. No. 09/849,841, filed May 4, 2001, which is now U.S. Pat. No. 6,583,576.

BACKGROUND OF THE INVENTION

1. Field of the Invention

The present invention relates to a light-emitting device. More particularly, the invention relates to an active matrix type light-emitting device having thin film transistors (TFTs) over an insulator.

2. Related Art

In recent years, the technique of forming TFTs over a substrate has made drastic progress to develop the applications to the active matrix type display device (or the light-emitting device). Especially, the TFTs using a poly-silicon film have a higher field effect mobility (or simply, a mobility) than that of the TFTs using an amorphous silicon film of the prior art so that they can act at a high speed. Therefore, the control of the pixels, as has been made in the prior art by a driver circuit outside of the substrate, can be made by a driver circuit which is formed over the substrate common to the pixels.

This active matrix type light-emitting device is enabled by forming various circuits and elements over the common substrate to have various advantages such as the reduction in the manufacture cost, the size reduction of an electro-optic device, the rise in the yield or the drop of the throughput.

Moreover, there has been vigorously investigated the active matrix type light-emitting device (or the EL display) which has EL elements as its light-emitting elements. The EL display is also called either the organic EL display (OELD) or the organic light emitting diode (OLED).

The EL display is of the spontaneous luminescence type. The EL element has a structure in which an EL layer is sandwiched between a pair of electrodes (i.e., an anode and a cathode), and the EL layer usually has a laminated structure, as represented by the structure of "hole transfer layer luminescent layer/electron transfer layer" proposed by Tang et al., of Kodak Eastman Company. This structure has such a high luminescence efficiency that most of the EL displays being investigated and developed adopt it.

The structure may be exemplified by another lamination of hole injection layer/hole transfer layer/luminescence layer/electron transfer layer, or hole injection layer/hole transfer layer/luminescence layer/electron transfer layer/electron injection layer over the anode. The luminescence layer may also be doped with a fluorescent pigment or the like.

Herein, all the layers to be interposed between the cathode and the anode will be generally called the "EL layer". Specifically, the EL layer means the layer which contains an organic EL material capable of establishing the EL (Electro Luminescence, as established by applying an electric field), and all the aforementioned hole injection layer, hole transfer layer, luminescence layer, electron transfer layer and electron injection layer are contained in the EL layer.

On the other hand, the luminescence to be obtained by the organic EL material is one (of fluorescence) at the return from a single excited state to the ground state or the other (of phosphorescence) at the return from the triple excited state to the ground state. The light-emitting device of the invention can adopt the EL element having either of the organic EL materials.

By applying a predetermined voltage to the EL layer having the aforementioned structure from the paired electrodes, moreover, the carriers in the luminescence layer are recombined to emit light. Herein, the light-emitting element, as formed of the anode, the EL layer and the cathode, will be called the EL element.

In the EL display, there are formed in a matrix shape a plurality of pixels, each of which has a thin film transistor (TFT) and an EL element. FIG. 17 shows a pixel of the EL display in an enlarged scale. A pixel 1700 is composed of a switching TFT 1701, a current controlling TFT 1702, an EL element 1703, a source signal line 1704, a gate signal line 1705, a current supply line 1706 and a capacitor 1707.

A gate electrode of the switching TFT 1701 is connected with the gate signal line 1705. On the other hand, one of the source region and the drain region of the switching TFT 1701 is connected with the source signal line, the other is connected with the gate electrode of the current controlling TFT 1702. A source region of the current controlling TFT 1702 is connected with the current supply line 1706 and a drain region of the current controlling TFT 1702 is connected with the anode or cathode of the EL element 1703.

Where the anode of the EL element 1703 is connected with the drain region of the current controlling TFT 1702, its anode is a pixel electrode, and its cathode is an opposed electrode. Where the cathode of the EL element 1703 is connected with the drain region of the current controlling TFT 1702, on the contrary, its anode is an opposed electrode, and its cathode is a pixel electrode.

Herein, the potential difference between the potential of the pixel electrode and the potential of the opposed electrode will be called the "EL driving voltage", which is applied to the EL layer.

Here, the capacitor 1707 need not always be provided. If any, the capacitor 1707 is connected with the current controlling TFT 1702 and the current supply line 1706, as shown in FIG. 17.

The potential (i.e., the supply potential) of the current supply line 1706 is held constant. The potential of the opposed electrode of the EL element 1703 is also held constant. This potential of the opposed electrode is given such a potential difference from the supply potential that the EL element may luminesce when the supply potential is applied to the pixel electrode of the EL element.

The switching TFT 1701 is turned ON with the selection signal inputted to the gate signal line 1705. Herein, the ON state of the TFT means that the drain current of the TFT takes a value of 0 or higher.

When the switching TFT 1701 is turned ON, the video signals, as inputted from the source signal line 1704, are inputted through the switching TFT 1701 to the gate electrode of the current controlling TFT 1702. Here, the inputting of a signal through the switching TFT 1701 to the gate electrode of the current controlling TFT 1702 means that the signal is inputted through the active layer of the switching TFT 1701 to the gate electrode of the current controlling TFT 1702.

The amount of the current to flow through the channel forming region of the current controlling TFT 1702 is controlled with a gate electrode Vgs or the potential difference between the gate electrode and the source region of the current controlling TFT 1702. Therefore, the potential to be applied to the pixel electrode of the EL element 1703 is determined by the level of the potential of the video signals, as inputted to the gate electrode of the current controlling TFT 1702. By the level of the potential fed to the pixel electrode, moreover, the luminescent luminance (i.e., the luminance of the light emitted by the EL element) of the EL element is controlled. In other words, the EL element 1703 is controlled in its luminance to effect the gradation display by the potential of the video signals inputted to the source signal line 1704.

In recent years, the reduction in the pixel size has been advanced to desire a finer image. This pixel miniaturization has increased the area for forming the TFT and the wiring line in one pixel thereby to reduce the pixel aperture ratio.

In order to achieve a high aperture ratio of each pixel in a regulated pixel size, therefore, it is essential to make an efficient layout of the circuit elements necessary for the circuit construction of the pixels.

In order to realize the active matrix type light-emitting device of the pixel aperture ratio, as described above, there has been desired a novel pixel construction.

SUMMARY OF THE INVENTION

In view of the desire, therefore, an object of the invention is to provide a light-emitting device which has pixels of a high aperture ratio by using a pixel construction in which a source signal line and a current supply line are exemplified by a common wiring line.

The invention is characterized in that the aperture ratio in pixels is enhanced by exemplifying a source signal line and a current supply line connected with a pixel unit, by a common wiring line.

The source signal line connected with a source signal line driver circuit and the current supply line connected with a power source are individually connected with a switching circuit. On the other hand, the switching circuit and the pixel unit are connected by the wiring line. Moreover, this wiring line is used as the source signal line or the current supply line by a switching signal inputted to the switching circuit.

DESCRIPTION OF THE PREFERRED EMBODIMENTS

Figure 1:
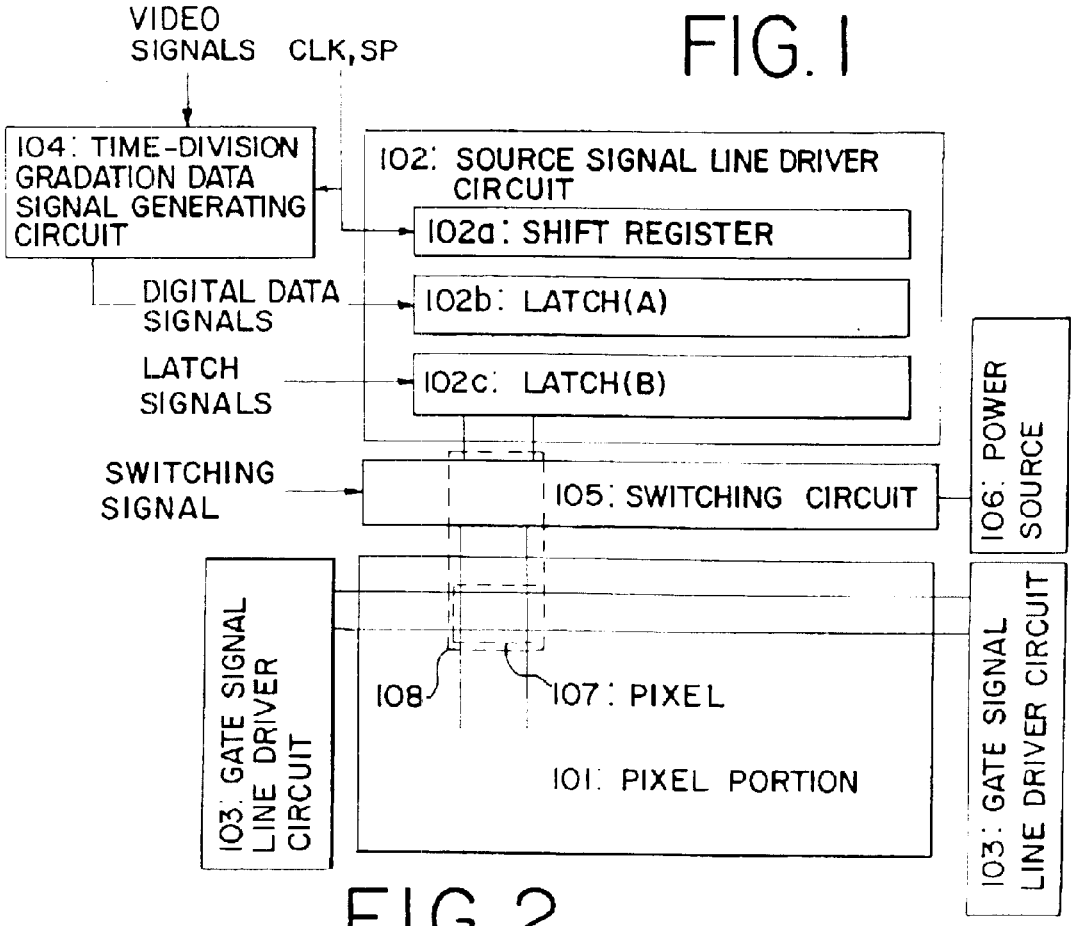
FIG. 1 is a diagram showing a circuit construction of a light-emitting device of the invention.

A block diagram of the light-emitting device of the invention is shown in FIG. 1. Here, a TFT to be included in the light-emitting device used in the invention is not limitative but may be exemplified by the planar type or the inverse stagger type. Moreover, the driver circuit of the light-emitting device to be used in the invention may be exemplified by combining the well-known ones.

In the invention, moreover, the element structure and material of an EL element belonging to the light-emitting device can be exemplified by those of the prior art. On the other hand, the construction of the invention can also be used to correspond to the well-known liquid crystal device.

The light-emitting device of FIG. 1 is provided with a pixel portion 101 of the TFT formed over a substrate, and a source signal line driver circuit 102 and gate signal line driver circuits 103 arranged in the periphery of the pixel portion 101. On the other hand, numeral 104 designates a time-division gradation data signal generating circuit (SPC: Serial-to-Parallel Conversion Circuit).

The source signal line driver circuit 102 is basically provided with a shift register 102*a*, a latch (A) 102*a*, a latch (B) 102*c*, and a buffer (not-shown).

Here, the light-emitting device of this embodiment is provided with one source signal line driver circuit but may be provided with two source signal line driver circuits over and below the pixel unit.

In the invention, on the other hand, the source signal line driver circuit 102 and the gate signal line driver circuits 103 may be constructed to overlie the substrate having the pixel portion 101 but may also be constructed to be formed over an IC chip and connected with the pixel portion 101 through an FPC or TAB.

In the source signal line driver circuit 102, a clock signal (CLK) and a start pulse (SP) are inputted to the shift register 102*a*. On the basis of those clock signal (CLK) and start pulse (SP), the shift register 102*a* generates timing signals sequentially and feeds them sequentially to a circuit at the subsequent stage through a (not-shown) buffer or the like.

The timing signal from the shift register 102*a* is buffed and amplified by the buffer or the like. The wiring line to be fed with the timing signal is connected with many circuits or elements so that its load capacity (or parasitic capacity) is high. The buffer is provided for preventing the "bluntness" of the rise or fall of the timing signal, as caused because of the high load capacity.

The timing signal thus buffed and amplified by the buffer is fed to the latch (A) 102*b*. This latch (A) 102*b* is composed of latches of a plurality of stages for processing n-bit digital data signals. In response to the timing signal, the latch (A) 102*b* fetches and latches the n-bit digital data signals, as fed from the time-division gradation data signal generating circuit 104, sequentially.

Here, the digital data signals may be sequentially inputted, when they are to be fetched by the latch (A) 102*b*, to the latches of the stages owned by the latch (A) 102*b*. However, the invention should not be limited to the construction. This construction may be made by the so-called "divisional drive", in which the latches of the stages owned by the latch (A) 102*b* are divided into several groups so that the digital data signals may be simultaneously inputted in parallel with the individual groups. Here, the number of the groups will be called the "dividing number". Where the latches are grouped for individual four stages, for example, it is said that the divided drive is performed by four.

The time period till the digital data signals are completely written in the latches of all stages of the latch (A) 102*b* will be called the "line period". Specifically, the line period is the time interval from the instant when the writing of the digital data signals in the latch at the most lefthand side of the latch (A) 102*b* to the instant when the writing of the digital data signals in the latch of the most righthand side is ended. As a matter of fact, the line period may contain the period which is the sum of the line period and the horizontal flyback period.

When one line period is ended, a latch signal is fed to the latch (B) 102*c*. At this instant, the digital data signals, as written and latched in the latch (A) 102*b*, are transmitted all at once to the latch (B) 102*c* so that they are written and latched in the latches of all stages of the latch (B) 102*c*.

In the latch (A) 102*b* having transmitted the digital data signals to the latch (B) 102*c*, on the basis of the timing signal from the shift register 102*a*, there are sequentially written the digital data signals which are fed again from the time-division gradation data signal generating circuit 104.

For this one line period of the second round, the digital data signals, as written and latched in the latch (B) 102*b*, are inputted to the source signal line. In the invention, this source signal line is connected with a switching circuit 105.

With this switching circuit 105, on the other hand, there is also connected a current feed line which is connected with a power source 106. In response to a switching signal inputted to the switching circuit 105, the wiring line connecting the switching circuit 105 and a pixel electrode is switched to the source signal line or the current supply line.

On the other hand, the switching signal switches the adjoining wiring lines alternately into the source signal line and the current supply line. In other words, both the adjoining wiring lines are not the source signal line or the current supply line.

Where the wiring line connected with the switching TFT of the pixel is connected with the source signal line, the pixel having that switching TFT exhibits the luminescence or not in response to the digital data signal inputted from the source signal line driver circuit. Where the wiring line connected with the switching TFT of the pixel is connected with the current supply line, however, the pixel having the switching TFT does not function.

Where the wiring line connected with the current controlling TFT of the pixel is connected with the current supply line, on the other hand, the pixel having the current controlling TFT exhibits the luminescence or not in response to the digital data signals inputted from the source signal line driver circuit. Where the wiring line connected with the current controlling TFT of the pixel is connected with the source signal line, however, the pixel having the current controlling TFT does not function.

On the other hand, the gate signal line driver circuit 103 has a shift register and a buffer (although neither shown). As the case may be, the gate signal line driver circuit 103 may have a level shifter in addition to the shift register and the buffer.

In the gate signal line driver circuit 103, the timing signal from the (not-shown) shift register is fed to the (not-shown) buffer and is fed to the corresponding gate signal line (which may also be called the "scanning line"). The gate signal line is connected with the gate electrode of the pixel TFT of one line, and all the pixel TFTs of one line have to be simultaneously turned ON. Therefore, the buffer to be used has to allow a high current to flow.

In the time-division gradation data signal generating circuit 104, the analog or digital video signals (containing graphic information) are converted into digital data signals for the time-division gradations and are inputted to the latch (A) 102*b*. On the other hand, this time-division gradation data signal generating circuit 104 also generates timing pulses or the like necessary for the time-division gradation displays.

This time-division gradation data signal generating circuit 104 may also be disposed outside of the light-emitting device of the invention. In this case, the construction is changed such that the digital data signals generated in the circuit 104 are inputted to the light-emitting device of the invention. In this case, the electric device (or the light-emitting device) having the light-emitting device of the invention as a display device contains the light-emitting device of the invention and the time-division gradation data signal generating circuit as separate parts.

On the other hand, the time-division gradation data signal generating circuit 104 may be packaged in the form of an IC chip on the light-emitting device of the invention. In this case, the construction is modified such that the digital data signals generated by the IC chip are inputted to the light-emitting device of the invention. In this case, the electric device having the light-emitting device of the invention as the display device contains the light-emitting device of the invention, on which the IC chip containing the time-division gradation data signal generating circuit packaged, as its parts.

Finally, the time-division gradation data signal generating circuit 104 can be formed by using the TFT over the substrate common to the pixel portion 101, the source signal line driver circuit 102 and the gate signal line driver circuit 103. In this case, all the video signals containing the graphic information can be processed, if inputted to the light-emitting device, over the substrate. The time-division gradation data signal generating circuit of this case can also be formed of the TFT which has a poly-silicon film as an active layer. In this case, on the other hand, the electric device having the light-emitting device of the invention as its display device is enabled to reduce its size by having the time-division gradation data signal generating circuit in the light-emitting device itself.

On the other hand, the construction of the source signal line driver circuit 102, as exemplified in this embodiment, is just one mode of embodiment but should not limit the construction of the invention.

Figure 4A:
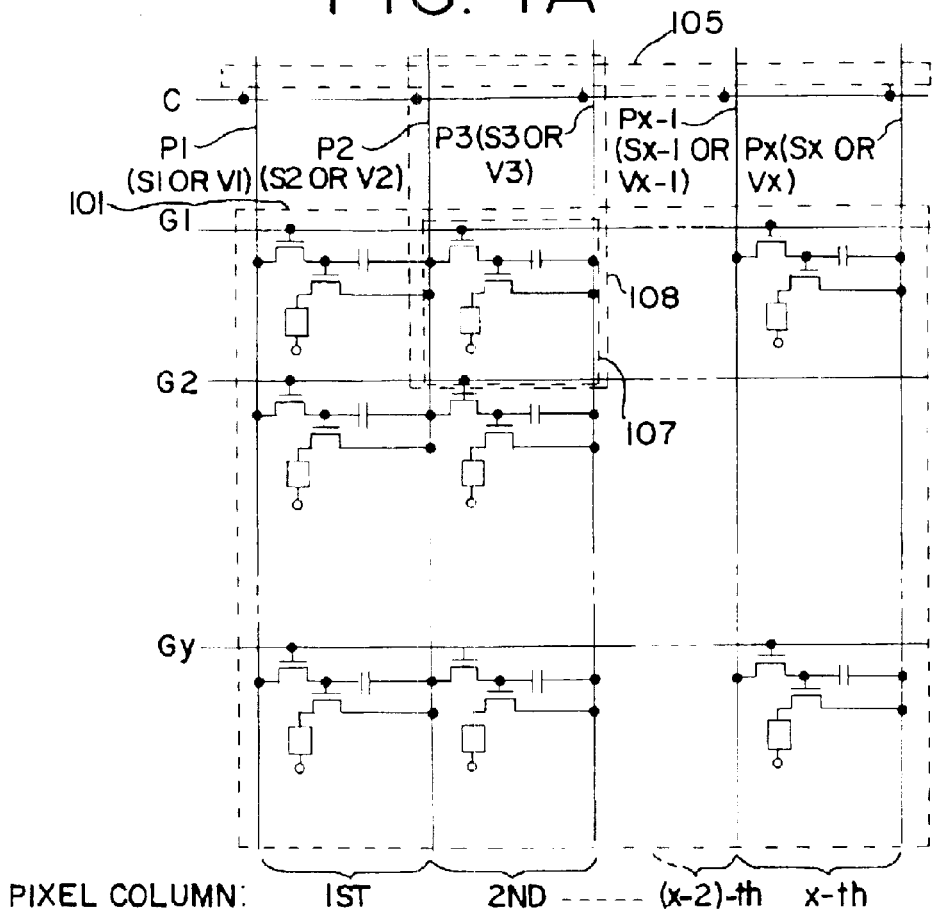
FIGS. 4A and 4B are circuit diagrams of a pixel portion of the light-emitting device of the invention.

Here will be described a structure of the pixel unit in the light-emitting device of the invention. The pixel portion 101 shown in FIG. 1 is shown in an enlarged scale in FIG. 4A. In FIG. 4A, the pixel portion 101 is provided with wiring lines (P1 to Px) for source signal lines (S1 to Sx) or current supply lines (V1 to Vx), and gate signal lines (G1 to Gy).

Here, a pixel 107 is located at the region which is composed individual one of the source signal lines (S1 to Sx), the current supply lines (V1 to Vx) and the gate signal lines (G1 to Gy). In the pixel portion 101, the plurality of pixels 107 are arranged in a matrix shape.

Outside of the pixel portion 101 of FIG. 4A, on the other hand, there is disposed the switching circuit 105. It is determined by a switching signal (C) to be fed to the switching circuit 105 whether the wiring lines (P1 to Px) to be connected with the individual pixels from the switching circuit 105 are directed to the source signal lines (S1 to Sx) or the current supply lines (V1 to Vx).

Figure 4B:
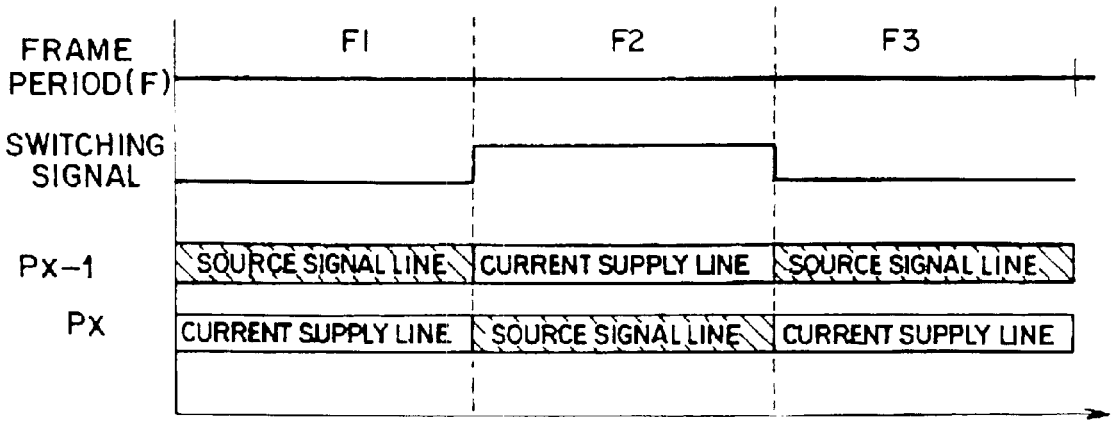

Here, FIG. 4B shows the switching signal inputted to the switching circuit 105 and the behavior, in which the wiring lines (P1 to Px) are alternatively for every one frame period by the switching signal for the source signal lines (S1 to Sx) and the current supply lines (V1 to Vx), by taking the wiring lines (Px−1) and Px in FIG. 4A. On the other hand, the pixel column having the wiring lines (Px−1) and Px will be called herein as the "(x−1)-th pixel column", and the pixel column having the wiring lines (Px−2) and (Px−1) will be called herein as the "(x−2)-th pixel column".

However, here is shown one example of the switching signals for the first to third frame periods, which should not limit the invention.

In this embodiment, either the drain region or the source region of the switching TFT is electrically connected with the source signal line and the source region of the current controlling TFT of the adjoining pixel.

When either the drain region or the source region of the switching TFT in the pixels of the (x−2)-th column is electrically connected with the source signal line, more specifically, either the source region or the drain region of the switching TFT in the pixels of the (x−1)-th column is electrically connected with the current supply lines of the pixels of the (x−2)-th column.

Figure 5:
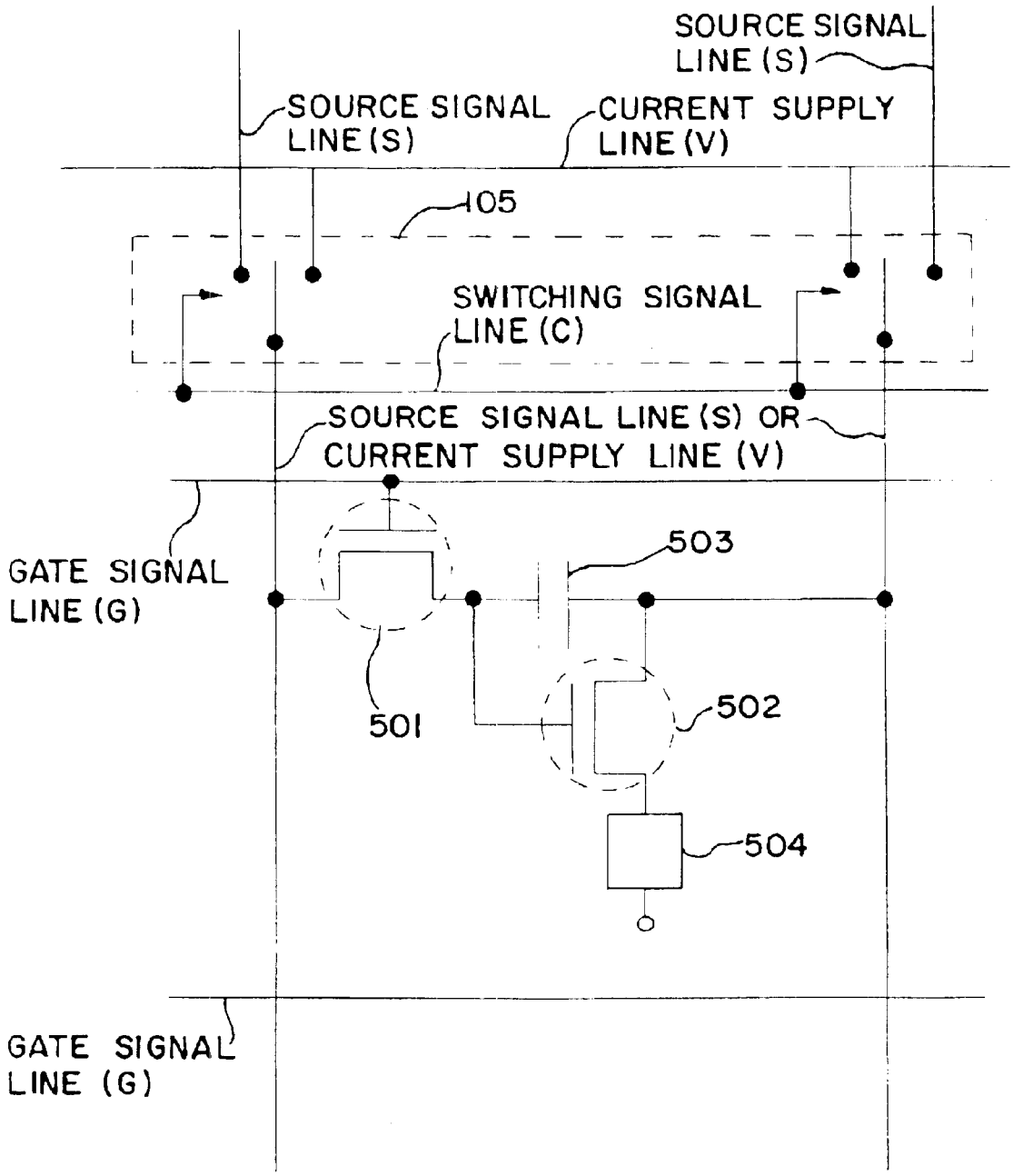
FIG. 5 is a circuit diagram of a pixel of the light-emitting device of the invention.

Next, a region 108 including the pixel 107 and the switching circuit 105 is shown in an enlarged scale in FIG. 5. In FIG. 5, numeral 501 designates a switching TFT. A gate electrode of the switching TFT 501 is connected with a gate signal line G (G1 to Gx). One of the source region and the drain region of the switching TFT 501 is connected with the source signal line S (S1 to Sx) or the current supply line V (V1 to Vx), whereas the other is connected with the gate electrode of a current controlling TFT 502 and a capacitor 503 owned by each pixel.

However, this pixel does not function where the switching TFT 501 is connected by the switching circuit 105 with the current supply line.

The capacitor 503 is provided for retaining the gate voltage (i.e., the potential difference between the gate electrode and the source region) of the current controlling TFT 502 when the switching TFT 501 is in the unselected state (or OFF state). Here is shown the construction having the capacitor 503, to which the invention should not be limited, but the construction may be modified not to have the capacitor 503.

On the other hand, one of the source region and the drain region of the current controlling TFT 502 is connected with the current supply line V (V1 to Vx) or the source signal line S (S1 to Sx), whereas the other is connected with an EL element 504. Here, the current supply line V is connected with the capacitor 503.

However, this element does not function where the current controlling TFT 502 is connected by the switching circuit 105 with the source signal line S (S1 to Sx).

The EL element 504 is formed of an EL layer between an anode and a cathode. Where the anode is connected with the source region or the drain region of the current controlling TFT 502, the anode acts as the pixel electrode whereas the cathode acts as the opposed electrode. Where the cathode is connected with the source region or the drain region of the current controlling TFT 502, on the contrary, the cathode acts as the pixel electrode whereas the anode acts as the opposed electrode.

The EL electrode 504 is fed at its opposed electrode with an opposed potential. On the other hand, the current supply line V is fed with the supply potential. These supply potential and opposed potential are fed by the power source which is provided in the light-emitting device of the invention by an external IC or the like.

The switching TFT 501 and the current controlling TFT 502 to be used may either an n-channel TFT or a p-channel TFT. Where the source region or the drain region of the current controlling TFT 502 is connected with the anode of the EL element 504, the current controlling TFT 502 is desired to be the p-channel TFT. Where the source region or the drain region of the current controlling TFT 502 is connected with the cathode of the EL element 504, on the other hand, the current controlling TFT 502 is desired to be the n-channel TFT.

On the other hand, the switching TFT 501 and the current controlling TFT 502 should not be limited to have the single-gate structure but may have a multi-gate structure such as a double-gate structure or a triple-gate structure.

Figure 6:
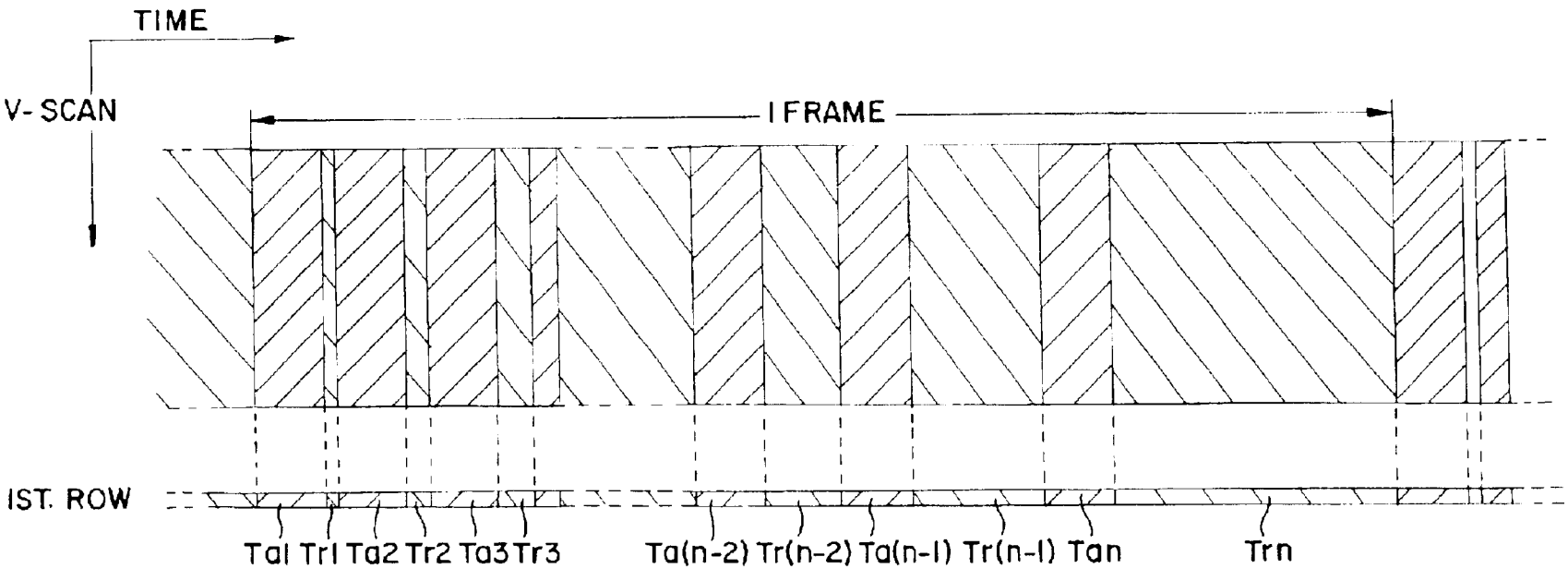
FIG. 6 is a diagram showing a drive method of the light-emitting device of the invention.

The drive method of the light-emitting device of the invention having the aforementioned construction will be described with reference to FIG. 6. In FIG. 6, there is illustrated a display period of pixels of the first line of the case in which a time (Time) is taken on an abscissa whereas a position (V-scan) of a gate signal line is taken on an ordinate.

Here is presented an example of the case in which the source signal line S(S1 to Sx) is connected with the source region of the switching TFT by the switching circuit 105 whereas the current supply line V (V1 to Vx) is connected with one current controlling TFT.

At first, the supply potential of the current supply line is equal to the potential of the opposed electrode of the EL element. The gate signal is then inputted from the gate signal line driver circuit to the gate signal line G. As a result, there are turned ON the switching TFTs 501 of all the pixels (i.e., the pixels of the first line) which are connected with the gate signal line G1.

Simultaneously with this, the digital video signal of the first bit is inputted from the source signal line driver circuit to the source signal line (S1 to Sx) which is electrically connected with the source signal line driver circuit switched by the switching circuit 105. The digital video signal is inputted through the switching TFT 501 to the gate electrode of the current controlling TFT 502.

Simultaneously as the input of the gate signal to gate signal line G1 is ended, the gate signal is likewise inputted to the gate signal line G2. Then, the switching TFTs 501 of all the pixels, as connected with the gate signal line G2, are turned ON, and the digital video signal of the first bit is inputted from the source signal line (S1 to Sx), which is electrically connected with the source signal line driver circuit by the switching circuit, to the pixels of the second line.

Then, the gate signal is inputted sequentially to all the gate signal lines (G1 to Gx). The time period, for which all the gate signal lines (G1 to Gx) are selected so that the digital video signal of the first bit is inputted to the pixels of all the lines, is the "write period Ta1".

When the write period Ta1 is ended, the "display period Tr1" is then started. For this display period Tr1, the supply potential of the current supply line has such a potential difference from the opposed electrode that the EL element may luminesce when the supply potential is fed to the pixel electrode of the EL element.

In this embodiment, moreover, the current controlling TFT 502 is OFF where the digital video signal has information "0". Therefore, the supply potential is not fed to the pixel electrode of the EL element 504. As a result, the EL element 504, to which the digital video signal having the information "0" is inputted, does not luminesce.

In the case of information "1", on the contrary, the current controlling TFT 502 is ON. Therefore, the supply potential is fed to the pixel electrode of the EL element 504. As a result, the EL element 504, to which the digital video signal having the information "1" is inputted, luminesce.

Thus, for the display period Tr1, the EL element 504 does or does not luminesce, and all the pixels display. The time period, for which the pixels are displaying, will be called the "display period Tr". Especially, the display period, which is started when the digital video signal of the first bit is inputted to the pixels, is called the "Tr1". In order to simplify the description, FIG. 6 shows only the display period of the pixels of the first line. The timings for the display periods of all the lines are identical.

When the display period Tr1 is ended, a write period Ta2 is started, and the supply potential of the current supply line is equal to the potential of the opposed electrode of the EL element. As in the case of the write period Ta1, moreover, all the gate signal lines are sequentially selected so that the digital video signal of the second bit is inputted all the pixels. The time period till the digital video signal of the second bit is inputted to the pixels of all the lines is called the "write period Ta2".

When the write period Ta2 is ended, a write period Ta2 is started, and the supply potential of the current supply line takes a level to establish such a potential difference from the opposed electrode that the EL element luminesce when the supply potential is fed to the pixel electrode of the EL element. Then, all the pixels perform displays.

The aforementioned actions are repeated till the digital video signals of the n-th bit are inputted to the pixels, so that the write period Ta and the display period Tr repeat their appearances. When all the display periods (Tr1 to Trn) end, one image can be displayed. In the drive method of the invention, one period for displaying one image is called "one frame period (F)". When the one frame period is ended, the next frame period is started. Then, the write period Ta1 appears again to repeat the aforementioned actions.

In the light-emitting device of the invention, it is preferable that 120 or more frame periods are prepared for 1 second, and that one frame period is 1/240 to 1/120 seconds, that is, frame frequency is 120 to 240 Hz. If the number of images to be displayed for 1 second is less than 120, the flicker may begin to become visually prominent.

In the invention, it is necessary that the sum of the durations of all the write periods is shorter than one frame period, and that the duration ratios of the display periods are Tr1:Tr2:Tr3: - - - :Tr(n−1):Trn=$2^0$:$2^1$:$2^2$: - - - :$2^{(n-2)}$: $2^{(n-1)}$. By this combination of display periods, it is possible to display a desired one of the $2^n$ gradations.

By determining the sum of the durations of the display periods for which the EL element is luminescing for one frame period, there is determined the gradation which is displayed by the pixel for the frame period. If the luminance of the case in which the pixel luminesces for all the display periods is 100% for n=8, for example, a luminance of 1% can be expressed where the pixels luminesce for Tr1 and Tr2. Where Tr3, Tr5 and Tr8 are selected, it is possible to express a luminance of 60%.

On the other hand, the display periods Tr1 to Trn may be made to appear in any sequence. For one frame period, for example, the display periods can be made to appear in the sequence of Tr1 and then Tr3, Tr5, Tr2, - - - , and so on.

Here, the level of the supply potential of the current supply line is changed between for the write period and for the display period, but the invention should not be limited thereto. The potential difference to allow the EL element to luminesce when fed at its pixel electrode with the supply potential may always be retained at the supply potential and the opposed electrode. Then, the EL element can luminesce even for the write period. Therefore, the gradation of the display to be made by the pixel for the frame period is determined by the sum of the durations of the write period and the display period for the EL element to luminesce for one frame period. In this case, the ratios of the sums of the durations of the write period and the display period, as corresponding to the digital bit signals of the individual bits, have to be (Ta1+Tr1):(Ta2+Tr2):(Ta3+Tr3): - - - :(Ta(n−1)+Tr(n−1)):(Tan+Trn)=$2^0$:$2^1$:$2^2$: - - - :$2^{(n-2)}$:$2^{(n-1)}$.

The upper face structure of the pixel unit, as has been described in connection with the mode of embodiment of the invention, will be further described with reference to FIG. 7.

Figure 7:
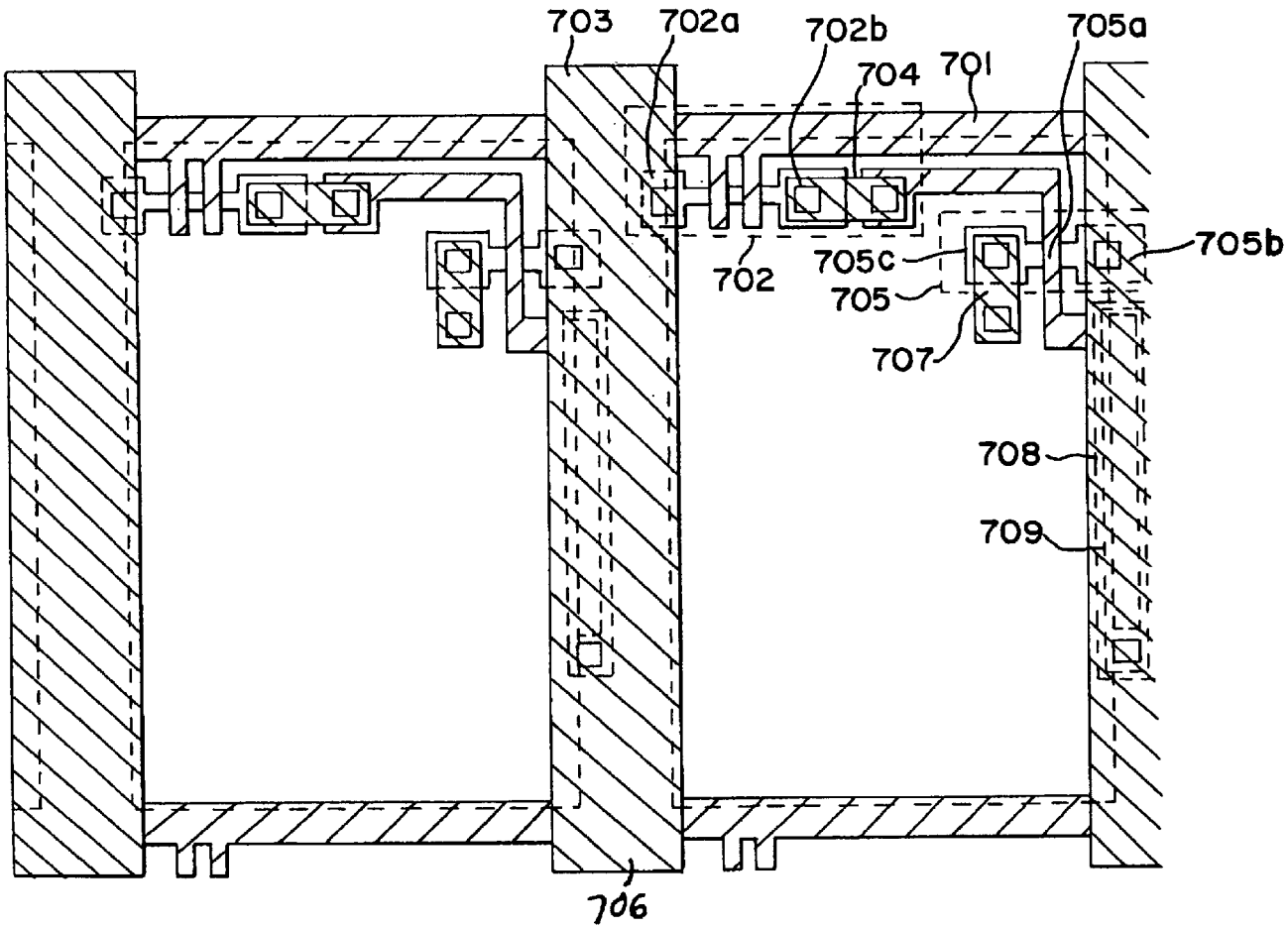
FIG. 7 is a top plan view of the light-emitting device of the invention.

In FIG. 7, a wiring line 701 is a gate wiring line for connecting the gate electrode of the switching TFT 702 electrically. On the other hand, the source region 702*a* of the switching TFT 702 is connected with a source wiring line 703 and at its drain region 702*b* with a drain wiring line 704. On the other hand, this drain wiring line 704 is electrically connected with the gate electrode 705*a* of a current controlling TFT 705. On the other hand, the source region 705*c* of the current controlling TFT 705 is electrically connected with a current supply line 706 and at its drain region 705*c* with a drain wiring line 707.

At this time, a storage capacitor is formed in a region 708. This storage capacitor 708 is formed between a semiconductor film 709 electrically connected with the current supply line 706 and a wiring line for forming a (not-shown) insulating film in the common layer of the gate insulating film and the gate electrode 705*a*. Here, the semiconductor film 709 is formed separately of the semiconductor film to be formed at the time of making the switching TFT and the current controlling TFT, so that it will be called herein the "separate semiconductor film". As shown in FIG. 7, more specifically the separate semiconductor film 709 is isolated from the active layer for forming the source region 702*a* and the drain region 702*b* of the switching TFT 702 and the source region 705*b* and the drain region 705*c* of the current controlling TFT 705. In the region designated by 708, the separate semiconductor film 709 overlaps the gate electrode 705*a* across the gate insulating film, to make a structure in which 60% or more of the separate semiconductor film 709 overlaps the wiring line forming the gate electrode 705*a*. In another structure, 60% or more of the separate semiconductor film 709 overlaps the current supply line 706 across the first layer insulating film. On the other hand, the capacitor, which is formed by the gate electrode 705*a*, the same (not-shown) layer as the first layer insulating film and the current supply line 706, can also be used as the storage capacitor.

In this embodiment, the pixel structure shown in FIG. 7 should not limit the invention in the least but provides just one preferred example. It is relied upon the suitable design of the, practitioner where the switching TFT, the current controlling TFT or the storage capacitor is to be formed.

[Embodiment 1]

Here will be described the construction of the switching circuit to be used in the invention, with reference to FIGS. 2 and 3A and 3B. The reference numerals used in FIGS. 2 and 3A and 3B can be suitably referred to those in FIG. 1.

Figure 2:
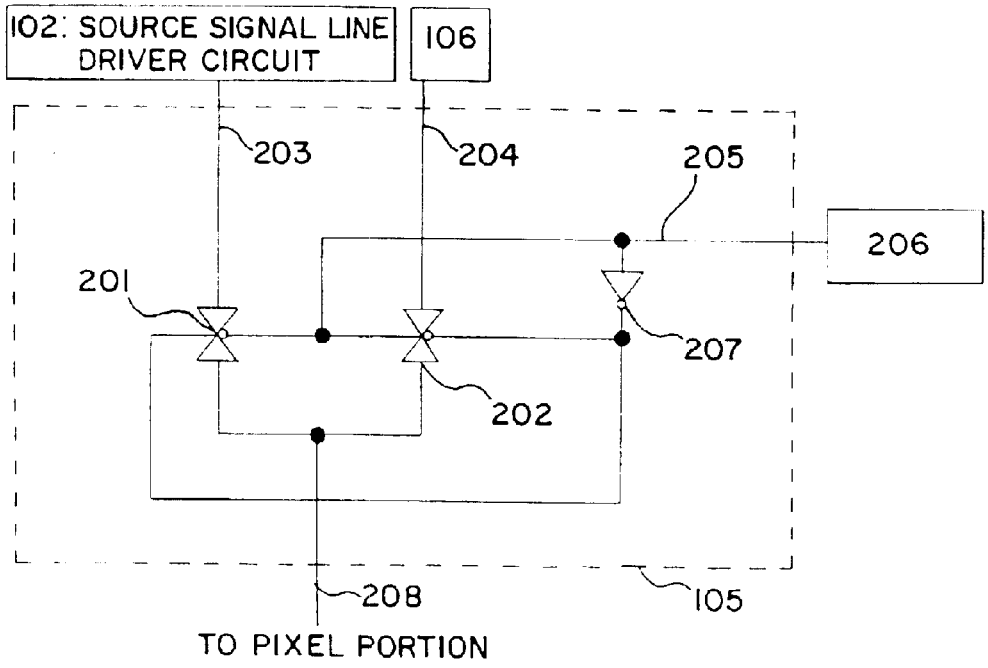
FIG. 2 is a diagram showing a switching circuit of the light-emitting device of the invention.

In FIG. 2, the switching circuit 105 is provided with two transmission gates, as discriminated by a transmission gate 1 (201) and a transmission gate 2 (202).

Moreover, the transmission gate 1 (201) is connected with the source signal line S (203), and the transmission gate 2 (202) is connected with a current supply line 204.

On the other hand, a source signal line 205 is connected with the transmission gate 1 (201) and the transmission gate 2 (202), and the circuit is constructed such that a switching signal from a switching signal generating circuit 206 and an inverted switching signal inverted from the switching signal by an inverter 207 are inputted to the transmission gate 1 (201) and the transmission gate 2 (202), respectively.

On the other hand, the switching signal to be inputted from the switching signal generating circuit 206 has the information "0" or "1", and one of the switching signals "0" and "1" has a "Hi" voltage whereas the other has a "Lo" voltage.

Figure 3A:
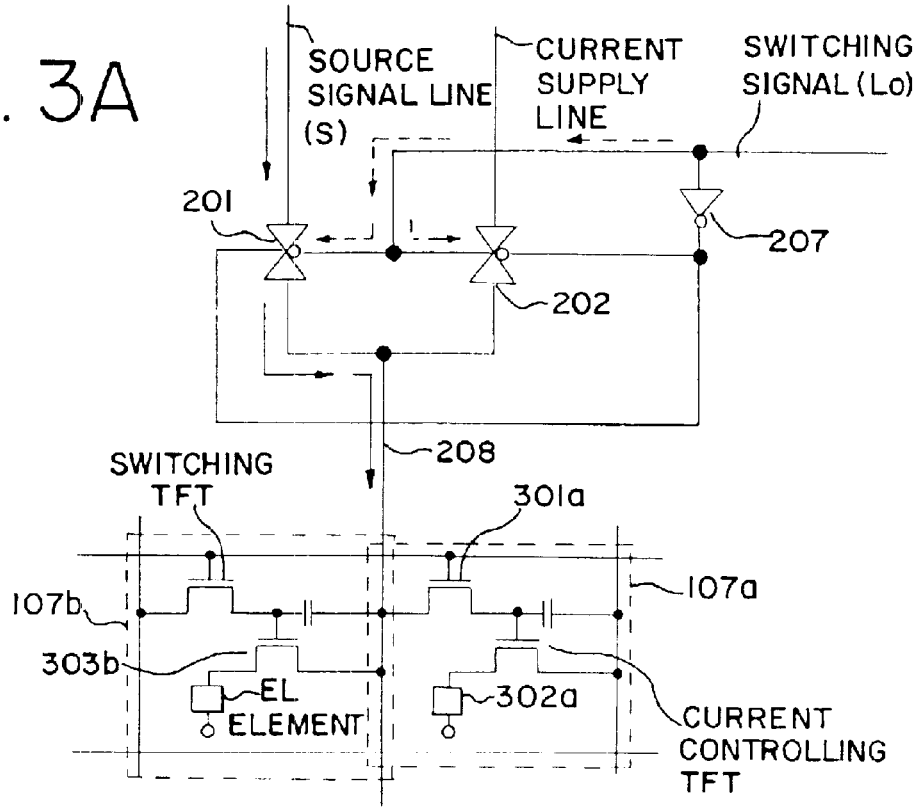
FIGS. 3A and 3B are diagrams showing switching circuits of the light-emitting device of the invention.

In this embodiment, where the switching signal has the information "0", the transmission gate 1 (201) is ON whereas the transmission gate 2 (202) is OFF, as shown in FIG. 3A. As a result, the transmission gate 1 (201) is ON so that the signal from the source signal line driver circuit 102 is inputted to the transmission gate 1 (201), and so that the signal from the source signal line driver circuit 102 is inputted to a wiring line 208 which is connected from the transmission gate 1 (201) and the transmission gate 2 (202) to a pixel portion 101. At this time, the wiring line 208 performs the function of the source signal line.

At this time, where the wiring line 208 acting as the source signal line is connected with a switching TFT 301*a* of a pixel 107*a,* as shown in FIG. 3A, an EL element 302*a* in the pixel 107*a* using the wiring line 208 as the source signal line exhibits the luminescence or not in response to the digital video signal inputted from the source signal line driver circuit 102.

Figure 3B:
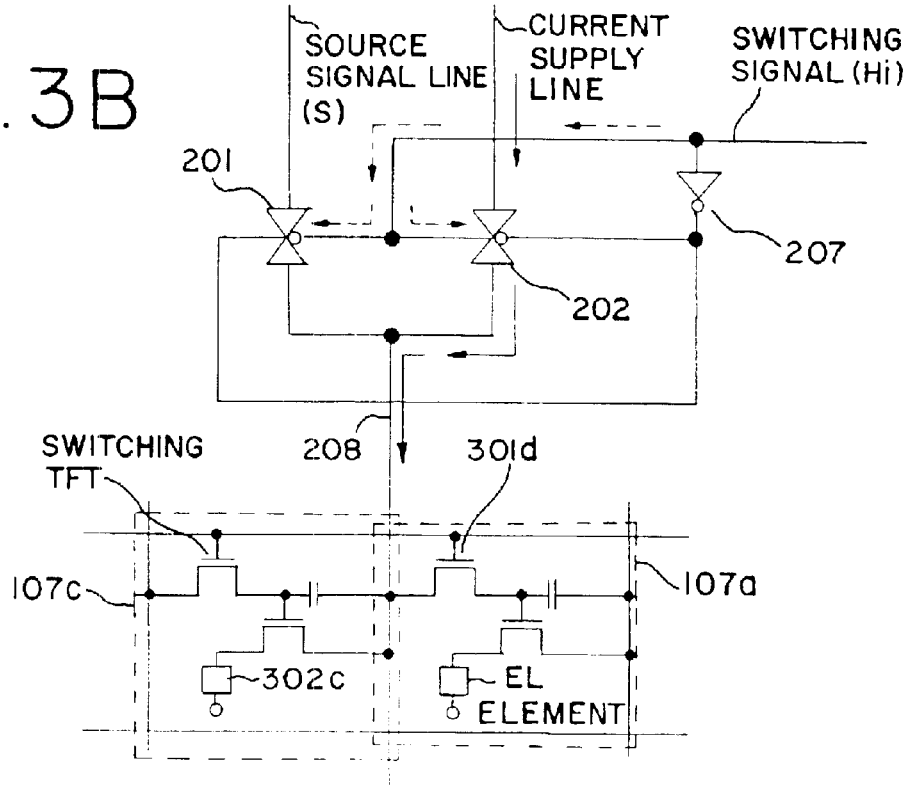

Thus, the EL element to be caused to luminesce in response to the digital video signal inputted from the source signal line driver circuit 102 will be called herein as the "selected (state) pixel".

Where the wiring line 208 acting as the source signal line is connected with a current controlling TFT 303*b* of a pixel 107*b,* as shown in FIG. 3A, no signal is inputted to the pixel 107*b* to bring the pixel 107*b* into an unselected state.

Where the switching signal has the information "1", on the contrary, the transmission gate 1 (201) is OFF, as shown in FIG. 3B, whereas the transmission gate 2 (202) is ON. As a result, the transmission gate 2 (202) is ON so that the signal is inputted from the power source 106 by the current supply line 205, and the signal from the power source 106 is inputted from the transmission gate 2 (202) to the wiring line 208 connected with the pixel portion 101. In short, the wiring line 208 acts as the current supply line.

At this time, where the wiring line 208 acting as the current supply line is connected at a pixel 107*c* with the current controlling TFT, as shown in FIG. 3B, an EL element 302*c* at the pixel 107*c* having the wiring line 208 as the current supply line exhibits the luminescence or not in response to the digital video signal inputted from the source signal line driver circuit 102. At this time, the pixel 107*c* is selected.

Where the wiring line 208 acting as the current supply line is connected with the switching TFT 301*d* of a pixel 107*d*, as shown in FIG. 3B, this pixel 107*d* is fed with no signal and is in the unselected state.

Here, when a pixel is selected, all the pixel columns connected with the same wiring line, as taken longitudinally toward the Drawing, are selected. When a pixel is not selected, on the contrary, none of the pixel columns connected with the same wiring line, as taken longitudinally toward the Drawing, is selected.

By switching the pixel columns to be selected for one frame, the source signal line and the current supply line may be alternately interchanged in the electric manner.

For example, therefore, the odd pixel columns, i.e., the first, third and fifth pixel columns can be selected from the lefthand side in the first frame, and the even pixel columns, i.e., the second, fourth and sixth pixel columns can be selected from the lefthand side in the second frame.

[Embodiment 2]

Here will be described a different structure of the pixel unit from the aforementioned one and a drive method of the pixel unit structure, when the light-emitting device having the different pixel unit structure is used in the invention. The description is made on the case in which the display of $2^n$ gradations is made by the digital data signal of n bits.

Figure 8:
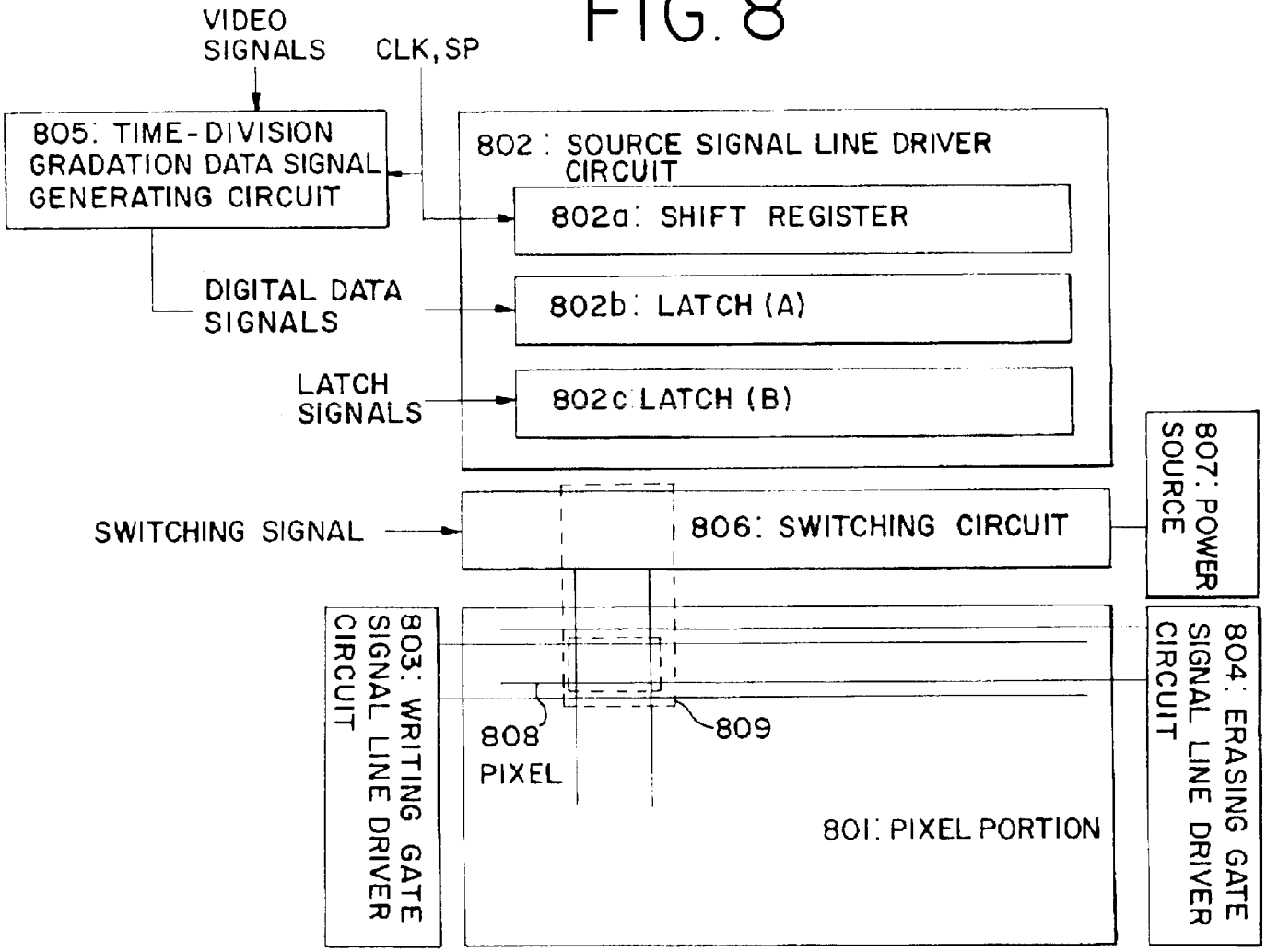
FIG. 8 is a diagram showing a circuit construction of a light-emitting device of the invention.

FIG. 8 shows one example of the block diagram in the light-emitting device of the invention. The light-emitting device of FIG. 8 is provided with a pixel portion 801 of the TFT formed over a substrate, a source signal line driver circuit 802, and a writing gate signal line driver circuit (or a first gate signal line driver circuit) 803 and an erasing gate signal line driver circuit (or a second gate signal line driver circuit) 804 arranged in the periphery of the pixel unit. In this embodiment, the light-emitting device has one source signal line driver circuit but may have two source signal line driver circuits in the invention.

In the invention, on the other hand, the source signal line driver circuit 802 and the writing gate signal line driver circuit 803 or the erasing gate signal line driver circuit 804 may be constructed to overlie the substrate having the pixel portion 801 but may also be constructed to be formed over an IC chip and connected with the pixel portion 801 through an FPC or TAB.

The source signal line driver circuit 802 is basically composed of a shift register 802*a,* a latch (A) 802*b* and a latch (B) 802*c*.

In the source signal line driver circuit 802, a clock signal (CLK) and a start pulse (SP) are inputted to the shift register 802*a*. On the basis of those clock signal (CLK) and start pulse (SP), the shift register 802*a* generates timing signals sequentially and feeds them sequentially to a circuit at the subsequent stage through a (not-shown) buffer or the like.

The timing signal from the shift register 802*a* is buffed and amplified by the buffer or the like. The wiring line to be fed with the timing signal is connected with many circuits or elements so that its load capacity (or parasitic capacity) is high. The buffer is provided for preventing the "bluntness" of the rise or fall of the timing signal, as caused because of the high load capacity.

The timing signal thus buffed and amplified by the buffer is fed to the latch (A) 802*b*. This latch (A) 802*b* is composed of latches of a plurality of stages for processing n-bit digital data signals. In response to the timing signal. the latch (A) 802*b* fetches and latches the n-bit digital data signals, as fed from the time-division gradation data signal generating circuit 805, sequentially.

Here, the digital data signals may be sequentially inputted, when they are to be fetched by the latch (A) 802*b,* to the latches of the stages owned by the latch (A) 802*b*. However, the invention should not be limited to the construction. This construction may be made by the so-called "divided drive", in which the latches of the stages owned by the latch (A) 802*b* are divided into several groups so that the digital data signals may be simultaneously inputted in parallel with the individual groups. Here, the number of the groups will be called the "dividing number". Where the latches are grouped for individual four stages, for example, it is said that the divided drive is performed by four.

The time period till the digital data signals are completely written in the latches of all stages of the latch (A) 802*b* will be called the "line period". Specifically, the line period is the time interval from the instant when the writing of the digital data signals in the latch at the most lefthand side of the latch (A) 802*b* to the instant when the writing of the digital data signals in the latch of the most righthand side is ended. As a matter of fact, the line period may contain the period which is the sum of the line period and the horizontal flyback period.

When one line period is ended, a latch signal is fed to the latch (B) 802*c*. At this instant, the digital data signals, as written and latched in the latch (A) 802*b*, are transmitted all at once to the latch (B) 802*c* so that they are written and latched in the latches of all stages of the latch (B) 802*c*.

In the latch (A) 802*b* having transmitted the digital data signals to the latch (B) 802*c*, on the basis of the timing signal from the shift register 802*a*, there are sequentially written the digital data signals which are fed again from the time-division gradation data signal generating circuit 805.

For this one line period of the second round, the digital data signals, as written and latched in the latch (B) 802*c*, are inputted to the source signal line.

Here, the source signal line is electrically connected with a switching circuit 806. On the other hand, the (not-shown) current supply line connected with a power source 807 is likewise electrically connected with the switching circuit 806. Of the source signal line and the current supply line, moreover, the line selected by the switching signal for controlling the switching circuit 806 is electrically connected with the pixel of the pixel portion 801.

In FIG. 8, the region containing the pixel 808 of the pixel portion 801 and the switching circuit 806 are designated by 809.

On the other hand, each of the writing gate signal line driver circuit 803 and the erasing gate signal line driver circuit 804 has a shift register and a buffer (although neither shown). As the case may be, the writing gate signal line driver circuit 803 and the erasing gate signal line driver circuit 804 may have a level shifter in addition to the shift register and the buffer.

In the writing gate signal line driver circuit 803 and the erasing gate signal line driver circuit 804, the timing signal from the (not-shown) shift register is fed to the (not-shown) buffer and is fed to the corresponding gate signal line (which may also be called the "scanning line"). The gate signal line is connected with the gate electrode of the pixel TFT of one line, and all the pixel TFTs of one line have to be simultaneously turned ON. Therefore, the buffer to be used has to allow a high current to flow.

In the time-division gradation data signal generating circuit 805, the analog or digital video signals (containing graphic information) are converted into digital data signals for the time-division gradations and are inputted to the latch (A) 802*b*. On the other hand, this time-division gradation data signal generating circuit 805 also generates timing pulses or the like necessary for the time-division gradation displays.

This time-division gradation data signal generating circuit 805 may also be disposed outside of the light-emitting device of the invention. In this case, the construction is changed such that the digital data signals generated in the circuit 104 are inputted to the light-emitting device of the invention. In this case, the electric device (or the light-emitting device) having the light-emitting device of the invention as a display contains the light-emitting device of the invention and the time-division gradation data signal generating circuit as separate parts.

On the other hand, the time-division gradation data signal generating circuit 805 may be packaged in the form of an IC chip on the light-emitting device of the invention. In this case, the construction is modified such that the digital data signals generated by the IC chip are inputted to the light-emitting device of the invention. In this case, the electric device having the light-emitting device of the invention as the display contains the light-emitting device of the invention, on which the IC chip containing the time-division gradation data signal generating circuit packaged, as its parts.

Finally, the time-division gradation data signal generating circuit 805 can be formed by using the TFT over the substrate common to the pixel portion 801, the source signal line driver circuit 802, the writing gate signal line driver circuit 803 and the erasing gate signal line driver circuit 804. In this case, all the video signals containing the graphic information can be processed, if inputted to the light-emitting device, over the substrate. The time-division gradation data signal generating circuit of this case can also be formed of the TFT which has a poly-silicon film as an active layer. In this case, on the other hand, the electric device having the light-emitting device of the invention as its display is enabled to reduce its size by having the time-division gradation data signal generating circuit in the light-emitting device itself.

Figure 9:
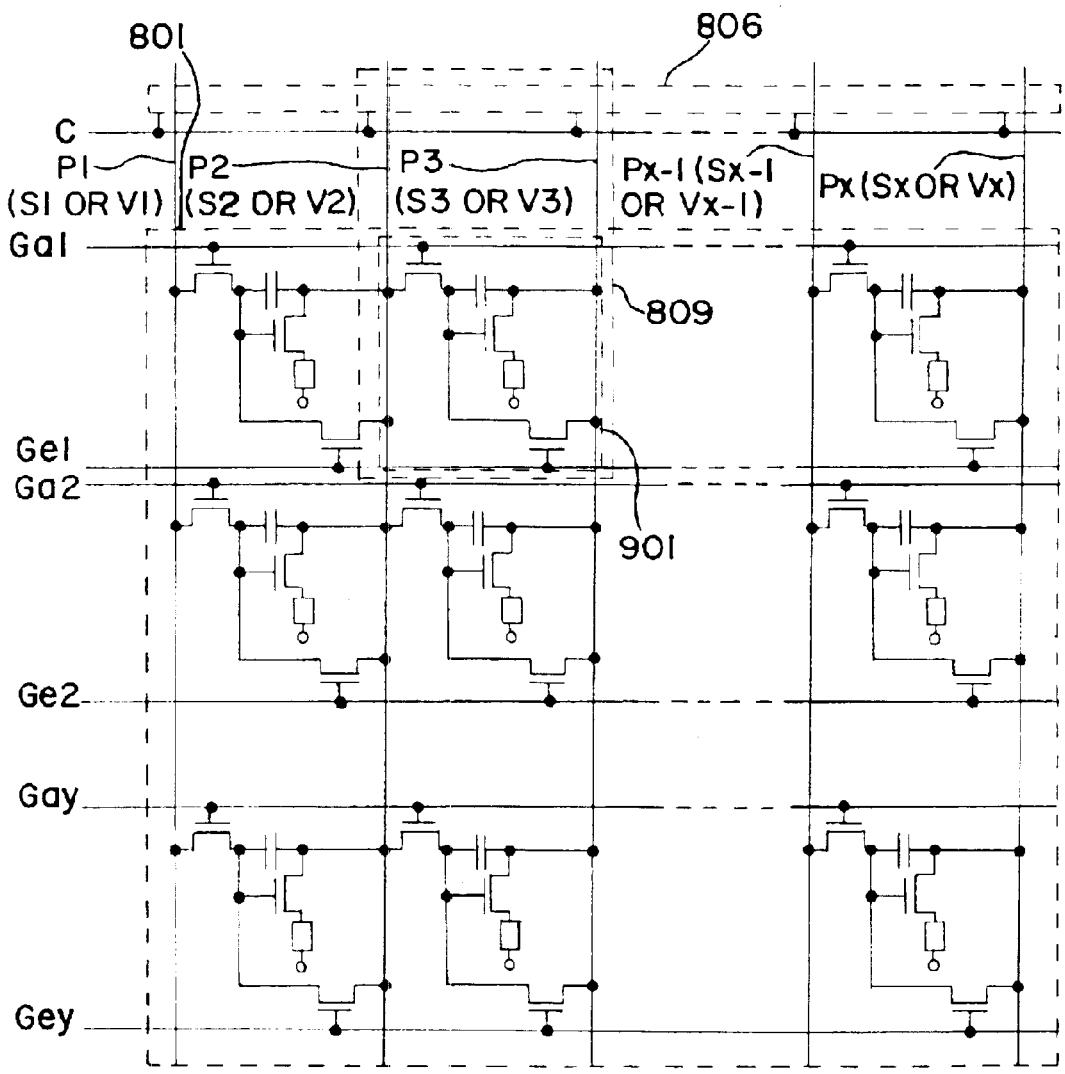
FIG. 9 is a circuit diagram of a pixel portion of the light-emitting device of the invention.

The pixel portion 801 is shown in an enlarged scale in FIG. 9. This pixel portion 801 is provided with: source signal lines (S1 to Sx) connected with the latch (B) 802*c* of the source signal line driver circuit 802; current supply lines (V1 to Vx) connected through an FPC with the power source outside of the light-emitting device; writing gate signal lines (or first gate signal lines) (Ga1 to Gay) connected with the writing gate signal line driver circuit 803; and erasing gate signal lines (or second gate signal lines) connected with the erasing gate signal line driver circuit 804.

Here, the wiring lines (P1 to Px) for connecting the switching circuit 806 and the pixels are switched to the source signal lines (S1 to Sx) or the current supply lines (V1 to Vx) by the switching circuit 806 which is disposed outside of the pixel portion 801.

A pixel 901 is the region which is provided with the source signal lines (S1 to Sx), the current supply lines (V1 to Vx), the writing gate signal lines (Ga1 to Gay) and the erasing gate signal lines (Ge1 to Gey). In the pixel portion 801, a plurality of pixels 901 are arrayed in the matrix shape.

Figure 10:
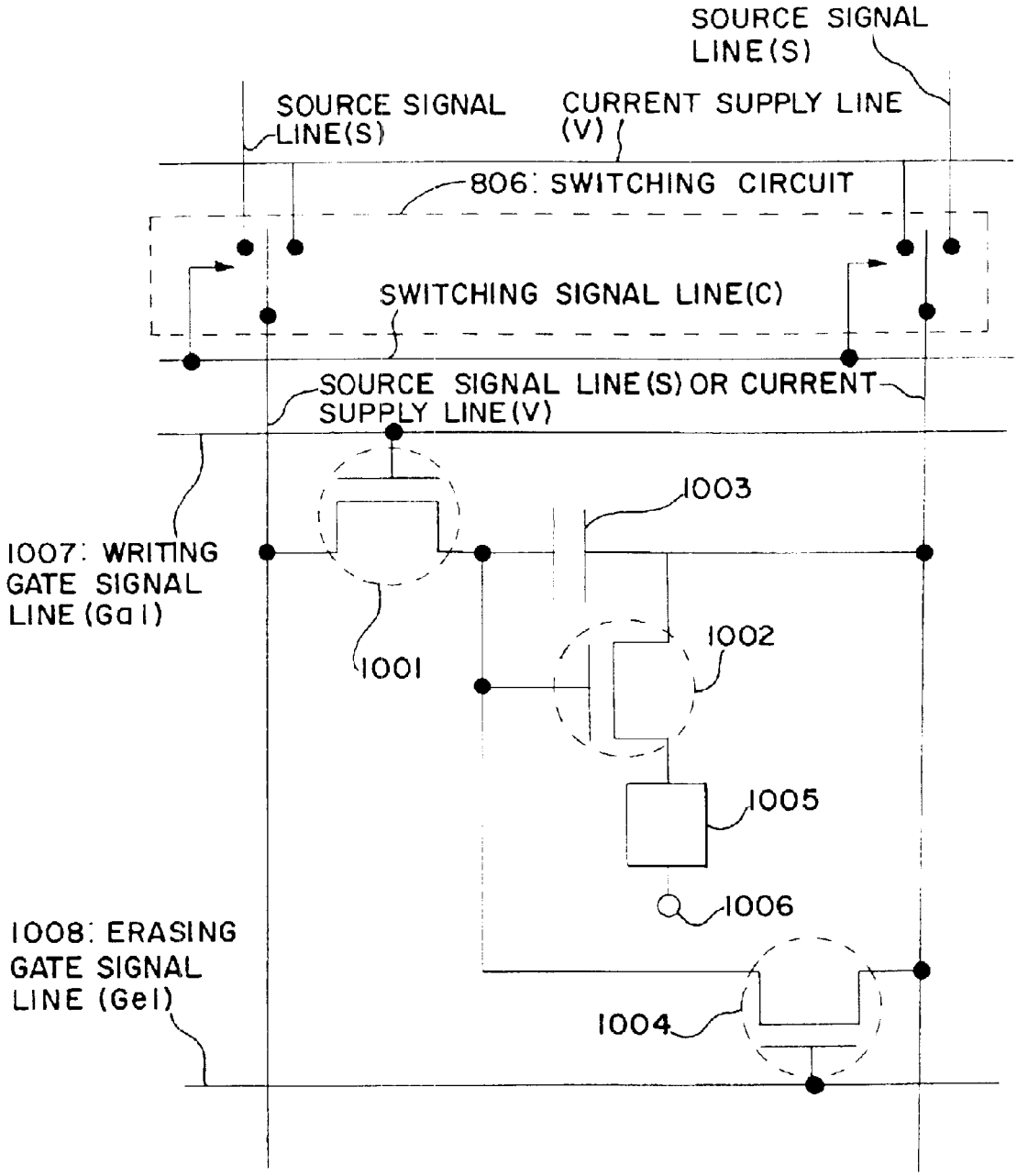
FIG. 10 is a circuit diagram of a pixel of the light-emitting device of the invention.

The region 809 including the pixel 901 and the switching circuit is shown in an enlarged scale in FIG. 10. In FIG. 10, numeral 1001 designates a switching TFT. A gate electrode of the switching TFT 1001 is connected with a writing gate signal line Ga (1007). One of the source region and the drain region of the switching TFT 1001 is connected with the source signal line S, whereas the other is connected with the gate electrode of a current controlling TFT 1002, a capacitor 1003 owned by each pixel and the source region or the drain region of an erasing TFT 1004. However, this pixel does not function where the switching TFT 1001 is connected by the switching circuit 806 with the current supply line.

The capacitor 1003 is provided for retaining the gate voltage of the current controlling TFT 1002 when the switching TFT 1001 is in the unselected state (or OFF state). In this embodiment, there is shown the construction having the capacitor 1003, to which the invention should not be limited, but the construction may be modified not to have the capacitor 1003.

On the other hand, one of the source region and the drain region of the current controlling TFT 1002 is connected with the current supply line V, whereas the other is connected with an EL element 1005. The current supply line V is connected with the capacitor 1003. However, this element does not function where the current controlling TFT 1002 is connected by the switching circuit 806 with the source signal line S (S1 to Sx).

Of the source region and the drain region of the erasing TFT 1004, on the other hand, the one which is not connected with the source region or the drain region of the switching TFT 1001 is connected with the current supply line V. Moreover, a gate electrode of the erasing TFT 1004 is connected with an erasing gate signal line Ge (1008).

The EL element 1005 is composed of an anode, a cathode and an EL layer formed between an anode and a cathode. Where the anode is connected with the source region or the drain region of the current controlling TFT 1002, the anode acts as the pixel electrode whereas the cathode acts as the opposed electrode. Where the cathode is connected with the source region or the drain region of the current controlling TFT 1002, on the contrary, the cathode acts as the pixel electrode whereas the anode acts as the opposed electrode.

The EL electrode 1005 is fed at its opposed electrode with an opposed potential. Moreover, the potential difference between the opposed potential and the supply potential is always kept at such a level for the EL element to luminesce when the supply potential is fed to the pixel electrode. These supply potential and opposed potential are fed by the power source which is provided in the light-emitting device of the invention by an external IC or the like. Here, the power source for the opposed potential will be especially called the "opposed power source 1006".

The typical light-emitting device at the present stage is required to have a current of several $mA/cm^2$ per the area of the pixel unit where the luminescence per the luminescent area of the pixel is 200 $cd/m^2$. As the screen size becomes the larger, therefore, it becomes the more difficult to control the level of the potential to be fed from the power source of the IC, with the switch. In the invention, the supply potential and the opposed potential are always kept constant, and the level of the potential to be fed from the power source of the IC need not be controlled with the switch so that the invention is useful for realizing a panel having a larger screen size.

In the invention, moreover, the supply potential is required to have such a potential level as to turn OFF the current controlling TFT 1002 when this TFT 1002 is fed at its gate electrode with the supply potential.

The switching TFT 1001, the current controlling TFT 1002 and the erasing TFT 1004 to be used may either the n-channel TFT or the p-channel TFT. On the other hand, the switching TFT 1001, the current controlling TFT 1002 and the erasing TFT 1004 should not be limited to have the single-gate structure but may have a multi-gate structure such as a double-gate structure or a triple-gate structure.

The drive method of the light-emitting device according to the invention, as shown in FIGS. 8 to 10, will be described with reference to FIG. 11.

At first, the writing gate signal line Ga1 (1007) is selected with a writing gate signal (or a first gate signal) to be inputted from the writing gate signal line driver circuit 803 to the writing gate signal line Ga1 (1007). And, there are turned ON the switching TFTs 1001 of all the pixels (i.e., the pixels of the first line) which are connected with the wiring gate signal line Ga1.

Simultaneously with this, the digital video signal of the first bit, as inputted from the source signal line driver circuit 802 to the source signal lines S1 to Sx, is inputted through the switching TFT 1001 to the current controlling TFT 1002. Here, it is to input the digital video signal to the pixel that the digital video signal is inputted through the switching TFT 1001 to the gate electrode of the current controlling TFT 1002.

The digital video signal has the information "0" or "1", and one of the digital video signals "0" and "1" has a "Hi" voltage whereas the other has a "Lo" voltage.

In this embodiment, the current controlling TFT 1002 is OFF where the digital video signal has information "0". Therefore, the supply potential is not fed to the pixel electrode of the EL element 1005. As a result, the EL element 1005, to which the digital video signal having the information "0" is inputted, does not luminesce.

Where the digital video signal has the information "1", on the contrary, the current controlling TFT 1002 is ON. Therefore, the supply potential is fed to the pixel electrode of the EL element 1005. As a result, the EL element 1005, to which the digital video signal having the information "1" is inputted, luminesce.

In this embodiment, where the digital video signal has the information "0", the current controlling TFT 1002 is turned OFF. Where the digital video signal has the information "1", the controlling TFT 1002 is turned ON. However, the invention is not limited to this construction. The current controlling TFT 1002 may be turned ON, where the digital video signal has the information "0", and may be turned OFF where the digital video signal has the information "1".

Thus, simultaneously with the input of the digital video signal to the pixels of the first line, the EL element 1005 does or does not luminesce, and the pixels of the first line display. The time period, for which the pixels are displaying, will be called the "display period Tr". Especially, the display period, which is started when the digital video signal of the first bit is inputted to the pixels, is called the "Tr1". The timings at which the display periods of the individual lines are started have individual time differences.

Where the selection of the writing gate signal line Ga1 is ended, the writing gate signal line Ga2 is selected with the writing gate signal. Then, the switching TFTs 1001 of all the pixels connected with the writing gate signal line Ga2 are turned ON, so that the digital video signals of the first bit are inputted to the pixels of the second line from the source signal lines S1 to Sx.

Then, all the writing gate signal lines Ga (Ga1 to Gay) are sequentially selected so that the digital video signals of the first bit are inputted to all the pixels. The time period till the digital video signals of the first bit are inputted to all the pixels is the writing period Ta1.

Before the digital video signals of the first bit are inputted to all the pixels, that is, before the writing period Ta1 is ended, on the other hand, the erasing gate signal line Ge1 (1008) is selected in parallel with the inputting of the digital video signals of the first bit to the pixels, with the erasing gate signal (or the second gate signal) which is inputted from the erasing gate signal line driver circuit 804 to the erasing gate signal line Ge1 (1008). Then, the erasing TFT 1004 of all the pixels (i.e., the pixels of the first line) connected with the erasing gate signal line Ge1 (1008) is turned ON. Then, the supply potential of the current supply lines V1 to Vx is fed to the gate electrode of the current controlling TFT 1002 through the erasing TFT 1004.

When the supply potential is fed to the gate electrode of the current controlling TFT 1002, the gate electrode and the source region of the current controlling TFT 1002 take the same potential so that the gate voltage is at 0 V. The current controlling TFT 1002 is turned OFF. Specifically, the digital video signal, which has been retained by the gate electrode of the current controlling TFT after the writing gate signal line Gal (1007) was selected with the writing gate signal, is erased by applying the supply potential to the gate electrode of the current controlling TFT. As a result, the supply potential is not applied to the pixel electrode of the EL element 1005, and none of the EL elements 1005 owned by the pixels of the first line luminesces so that the pixels of the first line do not display.

The period for which the pixels are not displaying is called the "non-display period Td". Simultaneously as the erasing gate signal line Ge1 (1008) is selected in the pixels of the first line, the display period Tr1 is ended to a non-display period Td1. Like the display period, the timings at which the non-display periods of the individual lines have time differences.

When the selection of the erasing gate signal line Ge1 (1008) is ended, moreover, the erasing gate signal line Ge2 is selected so that the erasing TFT 1004 of all the pixels (i.e., the pixels of the second line) connected with the erasing gate signal line Ge2 is turned ON. Then, the supply potential of the current supply lines V1 to Vx is fed through the erasing TFT 1004 to the gate electrode of the current controlling TFT 1002. When the supply potential is fed to the gate electrode of the current controlling TFT 1002, this current controlling TFT 1002 is turned OFF. The supply potential is not fed to the pixel electrode of the EL element 1005. As a result, none of the EL elements owned by the pixels of the second line luminesces to establish the state in which the pixels of the second line do not luminesce.

Then, the erasing gate signal is inputted sequentially to all the erasing gate signal lines. The time period till all the erasing gate signal lines Ge1 to Gey are selected so that the digital video signals of the first bit retained by all the pixels are erased is the "erasure period Te1".

Before the digital video signals of the first bit retained by all the pixels are erased, that is, before the erasure period Te1 is ended, on the other hand, the writing gate signal line Ga1 is selected again with the writing gate signal in parallel with the erasure of the digital video signals of the first bit retained by the pixels. Then, the digital video signals of the second bit are inputted to the pixels of the first line. As a result, the pixels of the first line display again so that the non-display period Td1 is ended to the display period Tr2.

Likewise, all the writing gate signal lines are sequentially selected so that the digital video signals of the second bit are inputted to all the pixels. The period till the digital video signals are completely inputted to all the pixels is called the "writing period Ta2".

Before the digital video signals of the second bit are inputted to all the pixels, that is, before the writing period Ta2 is ended, on the other hand the erasing gate signal line Ge2 is selected with the erasing gate signal in parallel with the inputting of the digital video signals of the second bit to the pixels. Therefore, none of the EL elements owned by the pixels of the first line luminesces so that the pixels of the first line do not display. Therefore, the display period Tr2 is ended in the pixels of the first line to a non-display period Td2.

Then, all the erasing gate signal lines Ge1 to Gey are sequentially selected so that the digital video signals of the second bit retained in all the pixels are erased. The time period till the digital video signals of the second bit retained by all the pixels are erased is the "erasure period Te2".

The aforementioned actions are repeated till the digital video signals of the m-th bit are inputted to the pixels, so that the display period Tr and the non-display period Td repeat their appearances. The display period Tr1 continues from the start of the writing period Ta1 to the start of the erasure period Te1. On the other hand, the non-display period Td1 continues from the start of the erasure period Te1 to the start of the writing period (i.e., the writing period Ta2 in this case) to next appear. Moreover, the display periods Tr2, Tr3, - - - , and Tr(m−1) and the non-display periods Td2, Td3, - - - , and Td(m−1) are individually determined like the display period Tr1 and the non-display period Td1 by the writing period Ta1, Ta2, - - - , and Tam and the erasure periods Te1, Te2, - - - , and Te(m−1).

Figure 11:
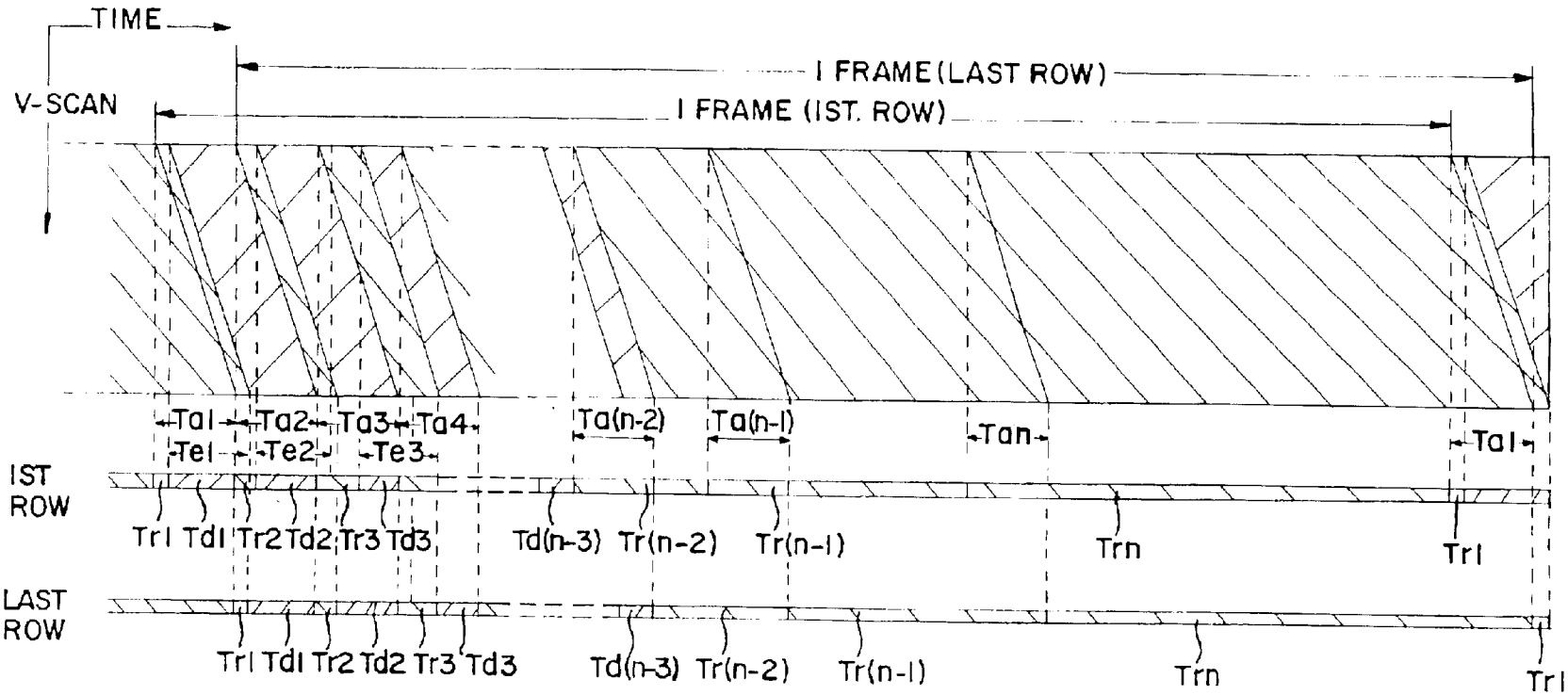
FIG. 11 is a diagram showing a drive method of the light-emitting device of the invention.

For conveniences of the description, FIG. 11 exemplifies the case of m=n−2. However, it is natural that the invention should not be limited thereto. In the invention, the value from 1 to n can be arbitrarily selected for m.

When the digital video signals of the m-th [(n−2)-th (the following parenthesized case is for m=n−2) bit are inputted to the pixels of the first line, these pixels of the first line display for the display period Trm[n−2]. Then, the digital video signals of the m[n−2]-th bit are retained in the pixels till the digital video signals of the next bit are inputted.

When the digital video signals of the (m+1)[n−1]-th bit are then inputted to the pixels of the first line, the digital video signals of the m[n−2]-th bit retained in the pixels are rewritten to the digital video signals of the (m+1)[n−1]-th bit. Then, the pixels of the first line are displayed for the display period Tr(m+1)[n−1]. The digital video signals of the (m+1)[n−1]-th bit are retained in the pixels till the digital video signals of the next bit are inputted.

The aforementioned actions are repeated till the digital video signals of the n-th bit are inputted to the pixels. The display periods Trm[n−2], - - - , and Tm continue from the starts of the writing periods Tam[n−2], - - - , and Tan to the starts of the writing periods to next appear.

When all the display periods Tr1 to Trn are ended, one image can be displayed. In the invention, the period for one image to be displayed is called the "one frame period (F)".

After the end of one frame period, moreover, the writing gate signal line Ga1 is selected again with the writing gate signal. Then, the digital video signals of the first bit are inputted to the pixels so that the pixels of the first one take again the display period Tr1. Then, the aforementioned actions are repeated again.

In the light-emitting device, it is preferable that 60 or more frame periods are prepared for 1 second. If the number of images to be displayed for 1 second is less than 60, the flicker may begin to become visually prominent.

In the invention, on the other hand, it is important that the sum of the durations of all the write periods is shorter than one frame period. Moreover, it is necessary that the durations of the display periods are Tr1:Tr2:Tr3: - - - :Tr(n−1) :Trn=$2^0$:$2^1$:$2^2$: - - - :$2^{(n-2)}$:$2^{(n-1)}$. By this combination of display periods, it is possible to display a desired one of the $2^n$ gradations.

By determining the sum of the durations of the display periods for which the EL element is luminescing for one frame period, there is determined the gradation which is displayed by the pixel for the frame period. If the luminance of the case in which the pixel luminesces for all the display periods is 100% for n=8, for example, a luminance of 1% can be expressed where the pixels luminesce for Tr1 and Tr2. Where Tr3, Tr5 and Tr8 are selected, it is possible to express a luminance of 60%.

It is essential that the writing period Tam for the digital video signals of the m-th bit to be written in the pixels is shorter than the display period Trm. It is, therefore, necessary, that the value of the bit number m has such one of 1 to n that the writing period Tam may be shorter than the display period Trm.

On the other hand, the display periods Tr1 to Trn may be made to appear in any sequence. For one frame period, for example, the display periods can be made to appear in the sequence of Tr1 and then Tr3, Tr5, Tr2, - - - , and so on. However, the more preferable sequence is that the display periods Tr1 to Trn do not overlap. On the other hand, the more preferable sequence is that the erasure periods Te1 to Ten do not overlap either.

With the construction thus far described, according to the invention, the dispersion of the current to be outputted when an equal gate voltage is applied to the current controlling TFTs can be suppressed by the TFTs even with more or less dispersion in the $I_{DS}$-$V_{GS}$. It is, therefore, possible to avoid the situation in which the luminescences of the EL elements are made seriously different between the adjoining pixels by the dispersion of the $I_{DS}$-$V_{GS}$ characteristics, even if signals at an equal voltage are inputted.

In this embodiment, on the other hand, first current controlling TFTs and second current controlling TFTs are arranged in parallel as the current controlling TFTs. As a result, the heat, as generated by the electric current to flow the active layer of the current controlling TFTs, can be efficiently radiated to suppress the deterioration of the current controlling TFTs. It is also possible to suppress the dispersion of the drain current which is caused by the dispersion of the characteristics such as the threshold value or the mobility of the current controlling TFTs.

In this embodiment, on the other hand, it is possible to provide the non-luminescence period for no display. In the case of the analog drive of the prior art, the EL elements always luminesce to cause the advance the deterioration of the EL layer, if a blank image is displayed in the light-emitting device. In this embodiment, the non-luminescence period can be provided to suppress the deterioration of the EL layer to some extent.

Here in this embodiment, the display period and the writing period partially overlap. In other words, the pixels can display even for the writing period. Therefore, the ratio (or the duty ratio) of the sum of the durations of the display periods for one frame period is not determined exclusively by the duration of the writing period.

Here, this embodiment is given a structure in which the capacitor is provided for retaining the voltage to be applied to the gate electrode of the current controlling TFT, but the capacitor can be eliminated. Where the current controlling TFT has an LDD region overlapping the gate electrode through the gate insulating film, a parasitic capacity, as generally called the "gate capacity" is established in the overlapping region. This gate capacity may be positively used as the capacitor for latching the voltage to be applied to the gate electrode of the current controlling TFT.

The value of this gate capacity changes with the overlapping area between the gate electrode and the LDD region so that it is determined by the length of the LDD region contained in the overlapping region.

Next, the pixel of the light-emitting device of this embodiment will be described with reference to the top plan view shown in FIG. 12. Here, FIGS. 9, 10 and 12 may be referred to one another because they use common reference characters.

Figure 12:
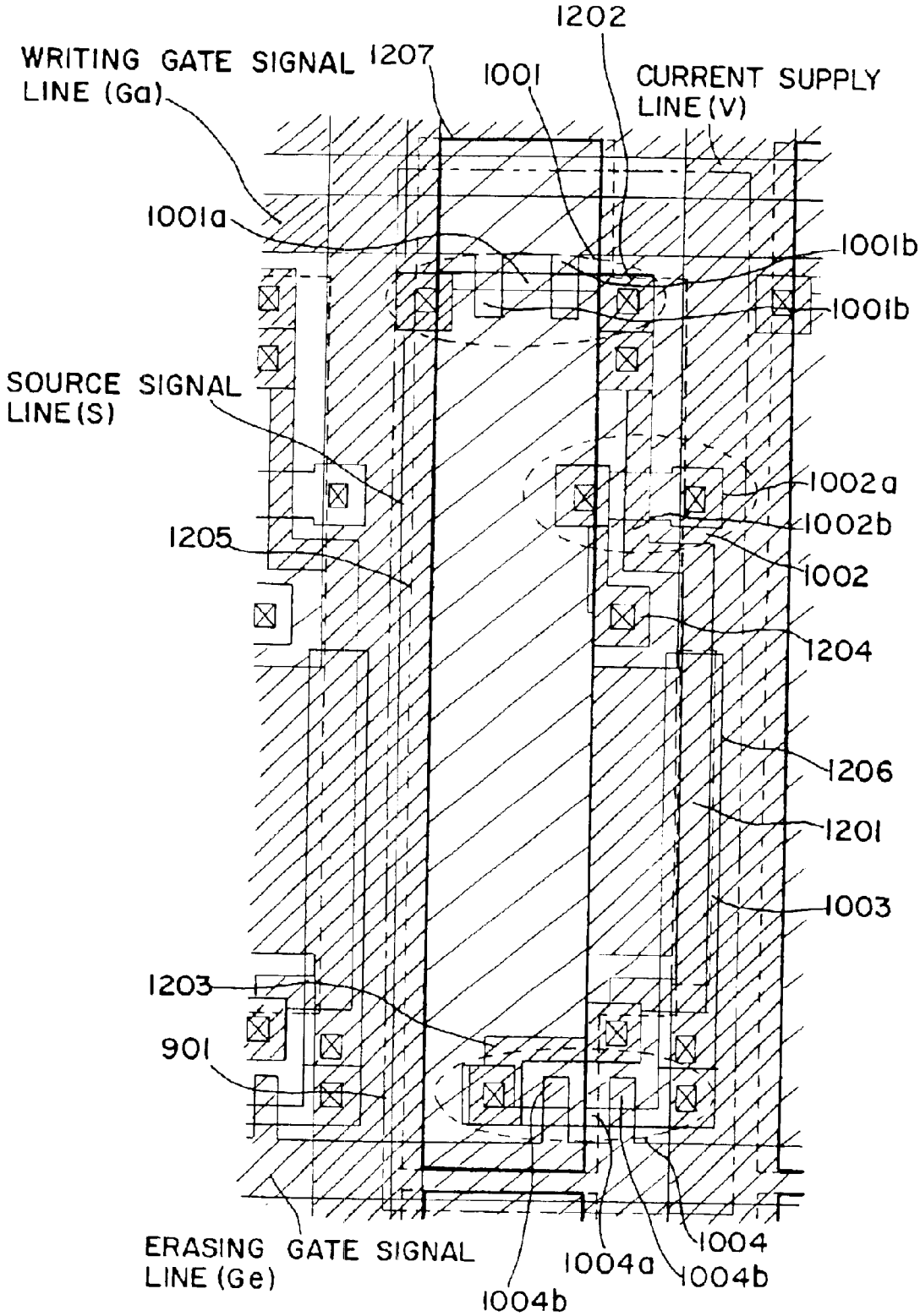
FIG. 12 is a top plan view of the light-emitting device of the invention.

In FIG. 12, the pixel is the region 901 which is provided with one source signal line (S), one current supply line (V), one writing gate signal line (Ga) and one erasing gate signal line (Ge). The pixel 901 is further provided with the switching TFT 1001, the current controlling TFT 1002 and the erasing TFT 1004.

The switching TFT 1001 is provided with an active layer 1001*a* and a gate electrode 1001*b* forming part of the writing gate signal line (Ga). The current controlling TFT 1002 is provided with an active layer 1002*a* and a gate electrode 1002*b* forming part of a gate wiring line 1201. The erasing TFT 1004 is provided with an active layer 1004*a* and a gate electrode 1004*b* forming part of the writing gate signal line (Ge).

One of the source region and the drain region owned by the active layer 1001*a* of the switching TFT 1001 is connected with the source signal line, and the other is connected with the gate wiring line 1201 through a connecting wiring line 1202. Here, the line 1202 is called either the source wiring line or the drain wiring line in dependence upon the potential of the signal to be inputted to the source signal line (S).

One of the source region and the drain region owned by the active layer 1004*a* of the erasing TFT 1004 is connected with the source signal line, and the other is connected with the gate wiring line 1201 through a connecting wiring line 1203. Here, the line 1202 is called either the source wiring line or the drain wiring line in dependence upon the supply potential of the current supply line (V).

The source region and the drain region owned by the active layer 1002*a* of the current controlling TFT 1002 are connected with the current supply line (V) and a drain wiring line 1204, respectively. This drain wiring line 1204 is connected with a pixel electrode 1205.

A capacity wiring line 1206 is formed of a semiconductor film. The capacitor 1003 is formed between the capacity wiring line 1206 electrically connected with the current supply line (V), and the (not-shown) insulating film in a common layer to the gate insulating film and the gate wiring line 1201. On the other hand, a capacitor, as formed of the gate wiring line 1201, the (not-shown) layer in a common layer to the first layer insulating film and the current supply line (V), can also be used as the capacitor.

Over the pixel electrode 1205, a bank having an aperture 1207 is formed by etching an organic resin film. Moreover, the EL layer and the opposed electrode are sequentially laminated over the pixel electrode 1205, although not shown. The pixel electrode 1205 and the EL layer contact in the aperture 1207 of the bank so that the EL layer luminesces at only the portion narrowed in contact with the opposed electrode and the pixel electrode.

Here, the top plan view of the pixel unit in the light-emitting device of the invention should not be limited to the construction shown in FIG. 12. On the other hand, this embodiment can be practiced in combination of the construction of Embodiment 1.

[Embodiment 3]

Figure 13A:
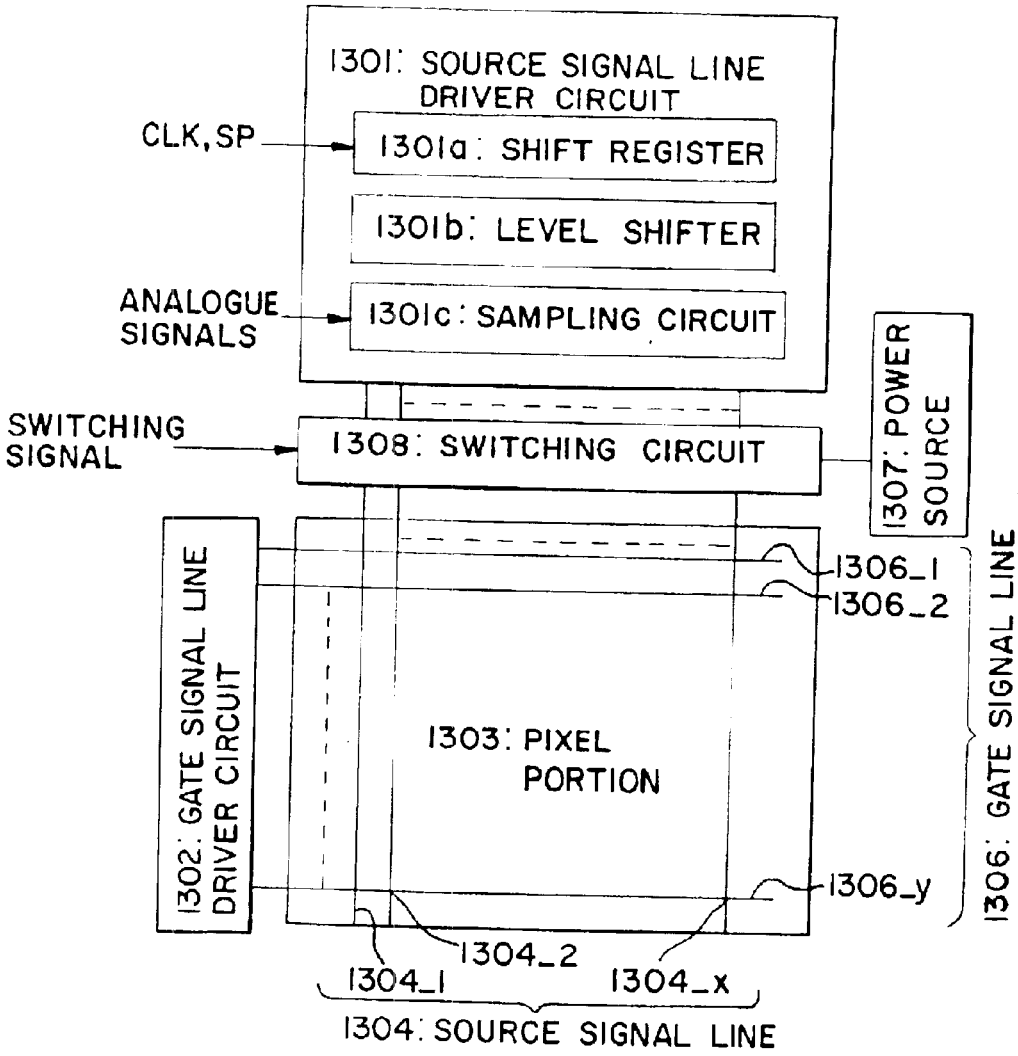
FIGS. 13A and 13B are diagrams showing a circuit construction of a light-emitting device of the invention.
Figure 13B:
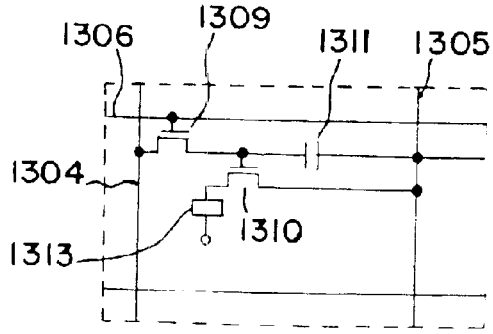
Figure 14:
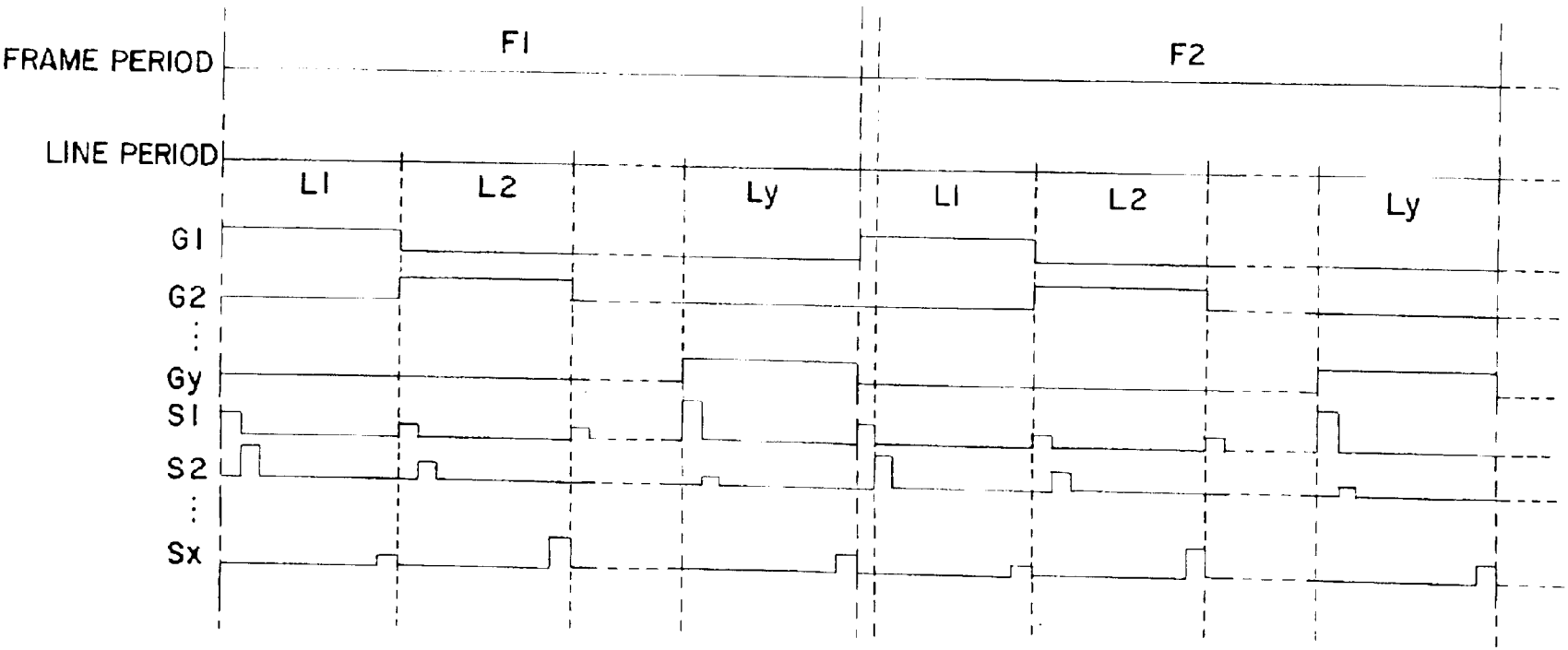
FIG. 14 is a diagram showing a drive method of the light-emitting device of the invention.

With reference to FIGS. 13A and 13B and 14, here will be described the case in which the light-emitting device of the invention is driven in an analog method.

FIG. 13A is a block diagram of the light-emitting device of this embodiment. Numeral 1301 designates a source signal line driver circuit; numeral 1302 designates a gate signal line driver circuit; and numeral 1303 designates a pixel portion. This embodiment is constructed to have one source signal line driver circuit and one gate signal line driver circuit, but the invention should not be limited to that construction. There may be provided two source signal line driver circuits and two gate signal line driver circuits.

The source signal line driver circuit 1301 is provided with a shift register 1301*a*, a level shifter 1301*b* and a sampling circuit 1301*c*. Of these, the level shifter 1301*b* may be employed, if necessary, but is not indispensable. In the construction of this embodiment, the level shifter 1301*b* is interposed between the shift register 1301*a* and the sampling circuit 1301*c* but the invention should not be limited to that construction. The construction may be modified such that the level shifter 1301*b* is incorporated into the shift register 1301*a*.

Here, a source signal line 1304 connected electrically with the source signal line driver circuit 1301 and the current supply line connected electrically with a power source 1307 are not connected directly with the pixel portion 1303, but the wiring line connected electrically from a switching circuit 1308 with the pixels is switched to the source signal line or the current supply line in response to the switching signal inputted to the switching circuit 1308 and is electrically connected with the pixel portion 1303.

In short, the wiring line connecting the switching circuit 1308 and the pixel portion 1303 is made so common that it is switched to the source signal line or the current supply line in response to the switching signal inputted to the switching circuit 1308. In this embodiment, however, the source signal lines over the pixels or the current supply lines are not adjacent to one another.

Since one wiring line is switched to the source signal line or the current supply line, as described above, there does not function the pixel where the wiring line connected with the switching TFT is the current supply line. In other words, the source signal line or the current supply line are not adjacent to each other but are alternately switched so that the pixels to function are alternately switched on every pixel columns in the vertical direction.

In the pixel portion 1303, there are individually intersected such ones 1304 (1304_1 to 1304_x) of the source signal lines connected with the source signal line driver circuit 1301 as are selected by the switching circuit 1308, the (not-shown) current supply line selected by the switching circuit 1308, and a y-number of gate signal lines 1306 (1306_1 to 1306_y) connected with the gate signal line driver circuit 1302. On the other hand, a current supply line 1305 is retained at a constant potential (or the supply potential) by connecting it with the power source 1307.

On the other hand, the gate signal line driver circuit 1302 is provided with a shift register and a buffer (although neither of them is shown). The driver circuit 1302 may be further provided with the level shifter.

A clock signal (CLK) and a start pulse signal (SP) are inputted as panel control signals to the shift register 1301*a*. From this shift register 1301*a*, there is outputted a sampling signal for sampling the video signals. The sampling signal outputted is inputted to the level shifter 1301*b* so that it is outputted with an enlarged potential amplitude.

The sampling signal thus outputted from the level shifter 1301*b* is inputted to the sampling circuit 1301*c*. Simultaneously with this, the video signals are inputted through the video signal line to the sampling circuit 1301*c*.

In this sampling circuit 1301*c*, the video signals inputted are sampled with the sampling signal and are individually inputted to the source signal lines 1304.

FIG. 13B shows a pixel structure of the pixel portion 1303 of the light-emitting device shown in FIG. 13A. The y-number of gate signal lines 1306 (1306_1 to 1306_y) for inputting the selection signal from the gate signal line driver circuit 1302 are connected with the gate electrodes of switching TFTs 1309 owned by the individual pixels. On the other hand, either the source region or the drain region of the switching TFT 1309 owned by each pixel is connected with an x-number source signal line 1304 (1304_1 to 1304_x) for inputting the video signals, and the remaining region is connected with the gate electrode of current controlling TFT 1310 owned by each pixel and a capacitor 1311 owned by each pixel.

A source region of the current controlling TFT 1310 owned by each pixel is connected with the current supply line 1305 and at its drain region with the anode or cathode of an EL element 1313. On the other hand, the current supply line 1305 is connected with the capacitor 1311 owned by each pixel. Here, this embodiment is exemplified by the construction having the capacitor 1311, which need not always be provided.

The EL element 1313 is composed of an anode, a cathode and an EL layer formed between an anode and a cathode. Where the anode of the EL element 1313 is connected with the drain region of the current controlling TFT 1310, the anode of the EL element 1313 acts as the pixel electrode whereas the cathode acts as the opposed electrode. Where the cathode of the EL element 1313 is connected with the drain region of the current controlling TFT 1310, on the contrary, the anode of the EL element 1313 acts as the opposed electrode whereas the cathode acts as the pixel electrode.

In FIG. 14, there is shown the timing chart of the case in which the light-emitting device described with reference to FIG. 13 is driven by the analog method. The period after one gate signal line was selected and before another gate signal line is selected is called the "one line period (L)". Here in this embodiment, the selection of the gate signal line means that a selection signal having a potential to turn ON the switching TFT is inputted to the gate signal line.

On the other hand, the period from the display of one image to the display of a next image corresponds to the one frame period (F). For example, the light-emitting device having the y-number of gate signal lines is provided with a y-number of line periods (L1 to Ly) for one frame period.

For the first line period (L1), the gate signal line 1306 is selected with the selection signal inputted from the gate signal line driver circuit 1302 so that all the switching TFTs 1309 connected with the gate signal line 1306 are turned ON. Then, the video signals are sequentially inputted from the source signal line driver circuit 1301 to the x-number of source signal lines (1304_1 to 1304_x). The video signals thus inputted to the source signal lines (1304_1 to 1304_x) are inputted through the switching TFT 1309 to the gate electrode of the current controlling TFT 1310.

The amount of the current to flow through the channel forming region of the current controlling TFT 1310 is controlled with a gate voltage $V_{gs}$ or the potential difference between the gate electrode and the source region of the current controlling TFT 1310. Therefore, the potential to be given to the pixel electrode of the EL element 1313 is determined by the level of the potential of the video signals inputted to the gate electrode of the current controlling TFT 1310. As a result, the EL element 1313 luminesces under the control of the potential of the video signals.

When the aforementioned actions are repeated to end the inputting of the video signals to the source signal lines 1304 (1304_1 to 1304_x), the first line period (L1) is ended. Here, the sum of the period to the end of the inputting of the video signals to the source signal lines 1304 (1304_1 to 1304_x) and the horizontal flyback period may be set to the one line period. When a second line period (L2) is then started, the gate signal line 1306_2 is selected with the selection signals so that the video signals are sequentially inputted like the first line period (L1) to the source signal lines 1304 (1304_1 to 1304_x).

When all the gate signal lines (1306_1 to 1306_y) are selected, all the line periods (L1 to Ly) are ended. When all the line periods (L1 to Ly) are ended, the one frame period is ended. For this one frame period, all the pixels are displayed to form one image. Here, the sum of all the line periods (L1 to Ly) and the vertical flyback period may be set to the one frame period.

Thus, the luminescence of the EL element is controlled with the potential of the video signals thereby to effect the gradation display.

The construction of this embodiment can be practiced by combining the constructions of Embodiment 1 and Embodiment 2.

[Embodiment 4]

For practicing the light-emitting device of the invention, the current controlling TFT may be driven with the region which has the following voltage-current characteristics.

First of all, in the driving case of the digital method, the current controlling TFT and the EL element are preferably driven so that the action point of the two elements, i.e., the current controlling TFT and the EL element (that is, the point where the voltage-current characteristics of the two elements take identical values) may be in the linear region. As a result, it is possible to perform the gradation display which suppresses the luminescence dispersion of the EL element, as caused by the displacement of the characteristics of the current controlling TFT.

In the case of the analog drive, on the other hand, the current controlling TFT and the EL element are preferably drive so that the action point may be located in the saturation region where the current value can be controlled by the gate voltage $|V_{GS}|$.

[Embodiment 5]

A light-emitting device has superior visibility in bright locations in comparison to a liquid crystal display device because it is a self-emissive type device, and moreover its field of vision is wide. Accordingly, it can be used as a display portion for various electric devices. For example, it is appropriate to use the light-emitting device of the present invention as a display portion of a light emitting device (an electro-optic device incorporating the light-emitting device in its casing) having a diagonal equal to 30 inches or greater (typically equal to 40 inches or greater) for appreciation of TV broadcasts by a large screen.

Note that all displays exhibiting (displaying) information such as a personal computer display, a TV broadcast reception display, or an advertisement display are included as the light-emitting display. Further, the light-emitting device of the present invention can be used as a display portion of the other various electric devices.

The following can be given as examples of such electric devices according to the present invention: a video camera; a digital camera; a goggle type display (head mounted display); a car navigation system; an audio reproducing device (such as a car audio system, an audio compo system); a notebook personal computer; a game equipment; a portable information terminal (such as a mobile computer, a mobile telephone, a mobile game equipment or an electronic book); and an image playback device provided with a recording medium (specifically, a device which performs playback of a recording medium and is provided with a display which can display those images, such as a digital video disk (DVD)). In particular, because portable information terminals are often viewed from a diagonal direction, the wideness of the field of vision is regarded as very important. Thus, it is preferable that the light-emitting device is employed. Examples of these electric devices are shown in FIGS. 15 and 16.

Figure 15A:
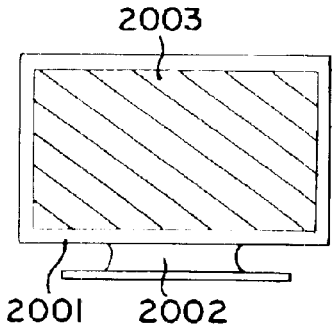
FIGS. 15A to 15F show electric devices using the light-emitting device of the invention.

FIG. 15A is a light-emitting device, containing a casing 2001, a support stand 2002, and a display portion 2003. The light-emitting device of the present invention can be used in the display portion 2003. Since the light-emitting device is a self-emissive type device without the need of a backlight, its display portion can be made thinner than a liquid crystal display device.

Figure 15B:
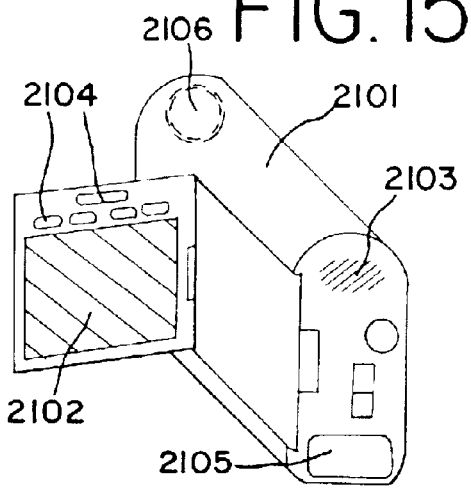

FIG. 15B is a video camera, containing a main body 2101, a display portion 2102, an audio input portion 2103, operation switches 2104, a battery 2105, and an image receiving portion 2106. The light-emitting device of the present invention can be used in the display portion 2102.

Figure 15C:
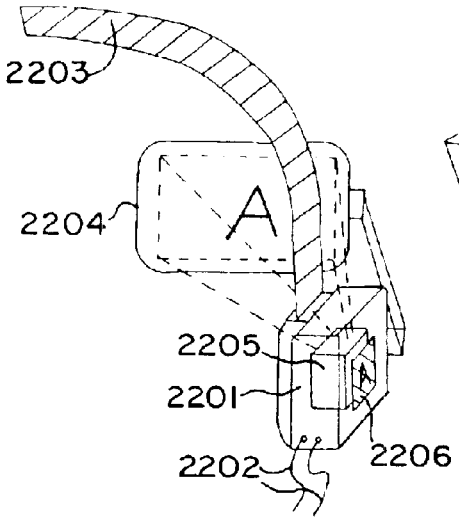

FIG. 15C is a portion of a head mounted type electro-optic device (right side), containing a main body 2201, a signal cable 2202, a head fixing band 2203, a screen portion 2204, an optical system 2205, and a display portion 2206. The light-emitting device of the present invention can be used in the display portion 2206.

Figure 15D:
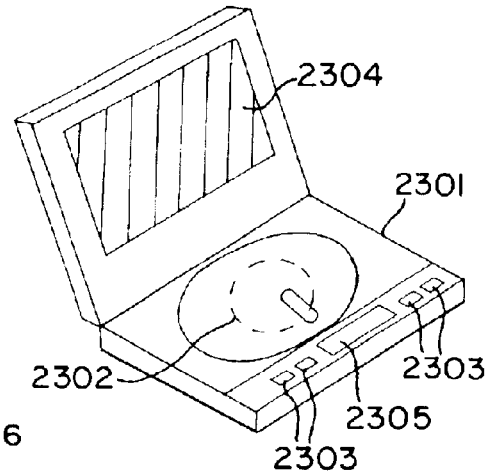

FIG. 15D is an image playback device (specifically, a DVD playback device) provided with a recording medium, containing a main body 2301, a recording medium (such as a DVD) 2302, operation switches 2303, a display portion (a) 2304, and a display portion (b) 2305. The display portion (a) 2304 is mainly used for displaying image information, and the image portion (b) 2305 is mainly used for displaying character information, and the light-emitting device of the present invention can be used in the display portions (a) 2304 and (b) 2305. Note that domestic game equipment is included as the image playback device provided with a recording medium.

Figure 15E:
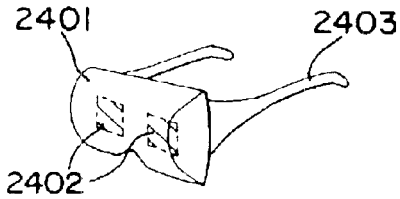

FIG. 15E is a goggle type display (head mounted display), containing a main body 2401, a display portion 2402, and an arm portion 2403. The light-emitting device of the present invention can be used in the display portion 2402.

Figure 15F:
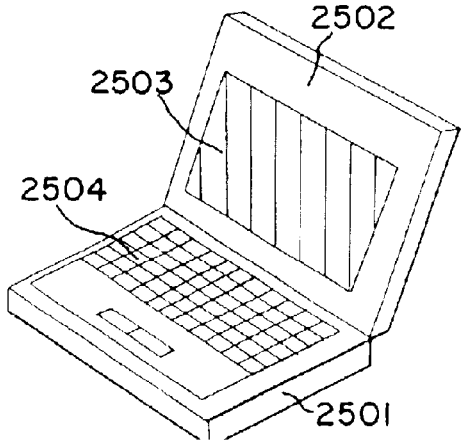

FIG. 15F is a personal computer, containing a main body 2501, a casing 2502, a display portion 2503, and a keyboard 2504. The light-emitting device of the present invention can be used in the display portion 2503.

Note that in the future if the emission luminance of EL materials becomes higher, the projection of light including outputted images can be enlarged by lenses or the like. Then it will become possible to use the light-emitting device in a front type or a rear type projector.

The above electric devices are becoming more often used to display information provided through an electronic transmission circuit such as the Internet or CATV (cable television), and in particular, opportunities for displaying animation information are increasing. The response speed of EL materials is extremely high, and therefore the light-emitting device is favorable for performing animation display.

The emitting portion of the light-emitting device consumes power, and therefore it is preferable to display information so as to have the emitting portion become as small as possible. Therefore, when using the light-emitting device in a display portion which mainly displays character information, such as a portable information terminal, in particular, a portable telephone and an audio reproducing device, it is preferable to drive it by setting non-emitting portions as background and forming character information in emitting portions.

Figure 16A:
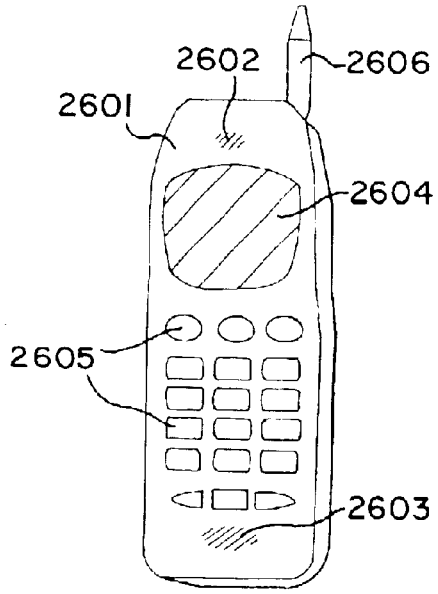
FIGS. 16A and 16B show electric devices using the light-emitting device of the invention.

FIG. 16A is a portable telephone, containing a main body 2601, an audio output portion 2602, an audio input portion 2603, a display portion 2604, operation switches 2605, and an antenna 2606. The light-emitting device of the present invention can be used in the display portion 2604. Note that by displaying white characters in a black background in the display portion 2604, the power consumption of the portable telephone can be reduced. Further, in the case where periphery is dark, it is effective that the power consumption can be reduced by decreasing the applied voltage, thereby lowering luminance.

Figure 16B:
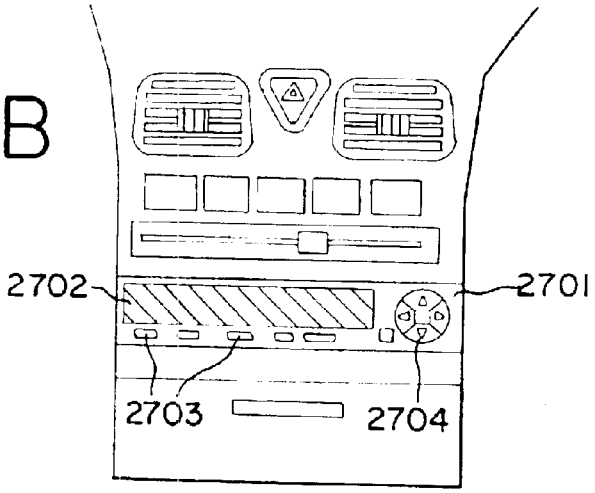
Figure 17:
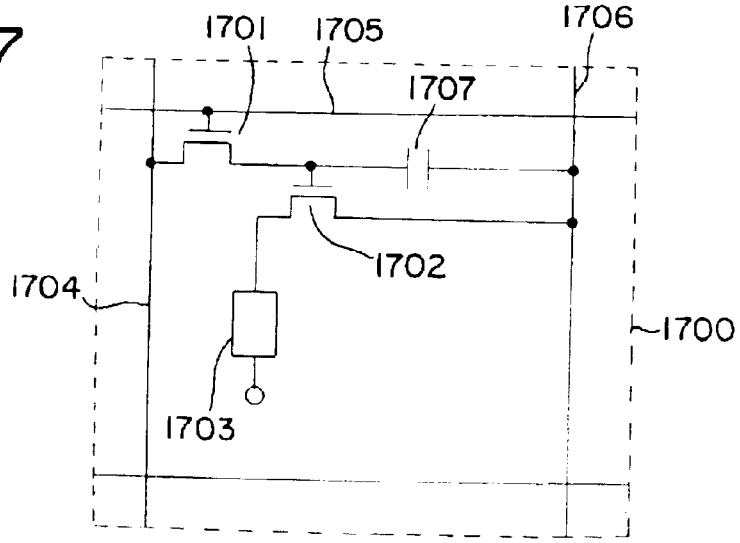
FIG. 17 PRIOR ART
FIG. 17 is a circuit diagram of a pixel portion of the conventional light-emitting device.

FIG. 16B is an audio reproducing device, specifically a car audio system, containing a main body 2701, a display portion 2702, and operation switches 2703 and 2704. The light-emitting device of the present invention can be used in the display portion 2702. Furthermore, an audio reproducing device for a car is shown in Embodiment 5, but it may also be used for a mobile type and a domestic type of audio reproducing device. Note that by displaying white characters in a black background in the display portion 2702, the power consumption can be reduced. This is particularly effective in a mobile type audio reproducing device.

The range of applications of the present invention is thus extremely wide, and it is possible to apply the present invention to electric devices in all fields. Furthermore, electric devices of the Embodiment 5 may use the light-emitting device having any constitution shown in Embodiments 1 to 4.

What is claimed is:

1. A light-emitting device comprising:

a source wiring line and a current supply line extending in parallel with each other;

a gate wiring line crossing the source wiring line and the current supply line;

a switching TFT electrically connected with the source wiring line and the gate wiring line;

a current controlling TFT electrically connected with the current supply line; and a storage capacitor comprising a semiconductor film extending below and in parallel with the current supply line, an insulating film, and a wiring line comprising a same material as a gate electrode of the current controlling TFT, wherein the semiconductor film is electrically connected with the current supply line, and wherein 60% or more of the semiconductor film overlaps the wiring line.

2. A light-emitting device according to claim 1, wherein the source wiring line and the current supply line are electrically interchanged for every frame period.

3. A light-emitting device according to claim 1, wherein the light-emitting device is an electro-luminescence display device.

4. A light-emitting device according to claim 1, wherein the light-emitting device is incorporated in at least one selected from a group consisting of a video camera, a digital camera, a goggle type display, an image playback device, an audio reproducing device, a personal computer, and a mobile telephone.

5. A light-emitting device according to claim 1, wherein 60% or more of the semiconductor film overlaps the current supply line.

6. A light-emitting device comprising:

a source wiring line and a current supply line extending in parallel with each other;

a gate wiring line crossing the source wiring line and the current supply line;

a switching TFT electrically connected with the current supply line;

a current controlling TFT electrically connected with the current supply line; and a storage capacitor comprising a semiconductor film extending below and in parallel with the source wiring line, an insulating film, and a wiring line comprising a same material as a gate electrode of the current controlling TFT, wherein the semiconductor film is electrically connected with the wiring line.

7. A light-emitting device according to claim 6, wherein the source wiring line and the current supply line are electrically interchanged for every frame period.

8. A light-emitting device according to claim 6, wherein 60% or more of the semiconductor film overlaps the wiring line.

9. A light-emitting device according to claim 6, wherein the light-emitting device is an electro-luminescence display device.

10. A light-emitting device according to claim 6, wherein the light-emitting device is incorporated in at least one selected from a group consisting of a video camera, a digital camera, a goggle type display, an image playback device, an audio reproducing device, a personal computer, and a mobile telephone.

11. A light-emitting device according to claim 6, wherein 60% or more of the semiconducto film overlaps the source wiring line.

12. A light-emitting device comprising:

a source wiring line and a current supply line extending in parallel with each other;

a gate wiring line crossing the source wiring line and the current supply line;

a switching TFT electrically connected with the source wiring line and the gate wiring line;

a current controlling TFT electrically connected with the current supply line; and a storage capacitor comprising a semiconductor film extending below and in parallel with the source wiring line, an insulating film, and a wiring line comprising a same material as a gate electrode of the current controlling TFT, wherein the semiconductor film is electrically connected with the source supply line, and wherein 60% or more of the semiconductor film overlaps the wiring line.

13. A light-emitting device according to claim 11, wherein the source wiring line and the current supply line are electrically interchanged for every one frame period.

14. A light-emitting device according to claim 12, wherein the light-emitting device is an electro-luminescence display device.

15. A light-emitting device according to claim 12, wherein the light-emitting device is incorporated in at least one selected from a group consisting of a video camera, a digital camera, a goggle type display, an image playback device, an audio reproducing device, a personal computer, and a mobile telephone.

16. A light-emitting device according to claim 12, wherein 60% or more of the semiconductor film overlaps the current supply line 17. A light-emitting device comprising:

a source wiring line and a current supply line extending in parallel with each other;

a gate wiring line crossing the source wiring line and the current supply line;

a switching TFT electrically connected with the source wiring line and the gate wiring line a current controlling TFT electrically connected with the current supply line; and a storage capacitor comprising a semiconductor film extending below and in parallel with the source wiring line, an insulating film formed on a same layer as a gate insulating film, and a wiring line comprising a same material as a gate electrode of the current controlling TFT, wherein the semiconductor film is electrically connected with the source wiring line.

18. A light-emitting device according to claim 17, wherein the source wiring line and the current supply line are electrically interchanged for every frame period.

19. A light-emitting device according to claim 17, wherein 60% or more of the semiconductor film overlaps the wiring line.

20. A light-emitting device according to claim 17, wherein the light-emitting device is an electro-luminescence display device.

21. A light-emitting device according to claim 17, wherein the light-emitting device is incorporated in at least one selected from a group consisting of a video camera, a digital camera, a goggle type display, an image playback device, an audio reproducing device, a personal computer, and a mobile telephone.

22. A light-emitting devoce according to claim 17, wherein 60% or more of the semiconductor wiring line.

23. A light-emitting device comprising:

a source wiring line and a current supply line extending in parallel with each other;

a gate wiring line crossing the source wiring line and the current supply line;

a switching TFT electrically connected with the source wiring line and the gate wiring line;

a current controlling TFT electrically connected with the current supply line; and a storage capacitor comprising a semiconductor film extending below and in parallel with the current supply line, an insulating film, and a wiring line comprising a same material a gate electrode of the current controlling TFT, wherein the semiconductor film is electrically connected with the current supply line, and wherein 60% or more of the semiconductor film overlaps the wiring line, and wherein the semiconductor film is separately formed from a semiconductor film of the switching TFT or the current controlling TFT.

24. A light-emitting device according to claim 23, wherein the source wiring line and the current supply line are electrically interchanged for every frame period.

25. A light-emitting device according to claim 23, wherein the light-emitting device is an electro-luminescence display device.

26. A light-emitting device according to claim 23, wherein the light-emitting device is incorporated in at least one selected from a group consisting of a video camera, a digital camera, a goggle type display, an image playback device, an audio reproducing device, a personal computer, and a mobile telephone.

27. A light-emitting device according to claim 23, wherein 60% or more of the semiconductor film overlaps the current supply line.

28. A light-emitting device comprising:

a source wiring line and a current supply line extending in parallel with each other;

a gate wiring line crossing the source wiring line and the current supply line;

a switching TFT electrically connected with the source wiring line and the gate wiring line;

a current controlling TFT electrically connected with the current supply line; and a storage capacitor comprising a semiconductor film extending below and in parallel with the source wiring line, an insulating film, and a wiring line comprising a same material as a gate electrode of the current controlling TFT, wherein the semiconductor film is electrically connected with the source wiring line, and wherein the semiconductor film is separately formed from a semiconductor film of the switching TFT or the current controlling TFT.

29. A light-emitting device according to claim 28, wherein the source wiring line and the current supply line are electrically interchanged for every frame period.

30. A light-emitting device according to claim 28, wherein 60% or more of the semiconductor film overlaps the wiring line.

31. A light-emitting device according to claim 28, wherein the light-emitting device is an electro-luminescence display device.

32. A light-emitting device according to claim 28, wherein the light-emitting device is incorporated in at least one selected from a group consisting of a video camera, a digital camera, a goggle type display, an image playback device, an audio reproducing device, a personal computer, and a mobile telephone.

33. A light-emitting device according to claim 28, wherein 60% or more of the semiconductor film overlaps the source wiring line.

* * * * *